US010794354B2

(12) United States Patent
Nakayama et al.

(10) Patent No.: US 10,794,354 B2
(45) **Date of Patent: *Oct. 6, 2020**

(54) IGNITION CONTROL APPARATUS FOR INTERNAL COMBUSTION ENGINE

(71) Applicant: DENSO CORPORATION, Kariya, Aichi-pref. (JP)

(72) Inventors: Satoru Nakayama, Kariya (JP); Makoto Toriyama, Chiryu (JP); Akimitsu Sugiura, Nagoya (JP); Masahiro Ishitani, Anjo (JP); Yuuki Kondou, Toyota (JP)

(73) Assignee: DENSO CORPORATION, Kariya (JP)

( * ) Notice: Subject to any disclaimer, the term of this patent is extended or adjusted under 35 U.S.C. 154(b) by 1342 days.

This patent is subject to a terminal disclaimer.

(21) Appl. No.: 14/783,575

(22) PCT Filed: Apr. 11, 2014

(86) PCT No.: PCT/JP2014/060553

§ 371 (c)(1),
(2) Date: Oct. 9, 2015

(87) PCT Pub. No.: WO2014/168248

PCT Pub. Date: Oct. 16, 2014

(65) Prior Publication Data

US 2016/0084213 A1 Mar. 24, 2016

(30) Foreign Application Priority Data

Apr. 11, 2013 (JP) ..... 2013-082958
Jul. 4, 2013 (JP) ..... 2013-140835

(51) Int. Cl.
*F02P 3/04* (2006.01)
*F02P 15/10* (2006.01)
(Continued)

(52) U.S. Cl.
CPC ..... *F02P 3/0407* (2013.01); *F02P 3/0442* (2013.01); *F02P 3/08* (2013.01); *F02P 3/0876* (2013.01);
(Continued)

(58) Field of Classification Search
CPC ..... F02P 3/0407; F02P 3/0442; F02P 3/08; F02P 9/007; F02P 15/10; F02P 3/0876; F02P 3/0552; F02P 3/0554
(Continued)

(56) References Cited

U.S. PATENT DOCUMENTS 3,357,415 A * 12/1967 Huntzinger ..... F02P 3/0884 123/604
4,174,697 A * 11/1979 Podrapsky ..... F02P 5/1556 123/406.56
(Continued)

FOREIGN PATENT DOCUMENTS

JP 60-249871 12/1985
JP 02-020466 6/1990
(Continued)

OTHER PUBLICATIONS

International Search Report (9 pages) dated Jul. 15, 2014, issued in PCT/JP2014/060553 and English translation (3 pages).
(Continued)

*Primary Examiner* — Mahmoud Gimie
*Assistant Examiner* — Joshua Campbell
(74) *Attorney, Agent, or Firm* — Nixon & Vanderhye P.C.

(57) ABSTRACT

In an ignition control apparatus, a control unit controls switching elements so as to supply a primary current to the other end side of a primary winding opposite to one end thereof connected to a DC power source by discharging (which is performed by turning on a second switching element stored energy from a capacitor during ignition
(Continued)

discharge (which is started by turning off a first switching element. In particular, the control unit controls the second switching element or the third switching element so as to provide variability to the amount of stored energy discharged from the capacitor according to an operating state of an internal combustion engine.

16 Claims, 13 Drawing Sheets

(51) Int. Cl.
*F02P 3/08* (2006.01)
*F02P 9/00* (2006.01)
*F02P 3/055* (2006.01)

(52) U.S. Cl.
CPC ..... *F02P 9/007* (2013.01); *F02P 15/10* (2013.01); *F02P 3/0552* (2013.01); *F02P 3/0554* (2013.01)

(58) Field of Classification Search
USPC ..... 123/634
See application file for complete search history.

(56) References Cited

U.S. PATENT DOCUMENTS

| | | | | |
|---|---|---|---|---|
| 4,255,789 | A * | 3/1981 | Hartford | F02D 41/263 123/406.65 |
| 4,413,608 | A | 11/1983 | Beeghly | |
| 5,881,082 | A | 3/1999 | Yabuuchi | |
| 2002/0066444 | A1 | 6/2002 | Ikeda et al. | |
| 2007/0175461 | A1 | 8/2007 | Wada et al. | |
| 2007/0181110 | A1 * | 8/2007 | Toriyama | F02P 3/0552 123/637 |
| 2007/0266979 | A1 * | 11/2007 | Nagamine | F02D 41/3041 123/143 B |
| 2008/0127937 | A1 | 6/2008 | Toriyama et al. | |
| 2012/0186569 | A1 | 7/2012 | Shimakawa et al. | |
| 2013/0152901 | A1 | 6/2013 | Shishime et al. | |
| 2014/0041611 | A1 * | 2/2014 | Ikeda | F02M 27/042 123/143 B |

FOREIGN PATENT DOCUMENTS

| | | | | |
|---|---|---|---|---|
| JP | 6-178544 | | 6/1994 | |
| JP | 10-084680 | | 3/1998 | |
| JP | 2000-199470 | | 7/2000 | |
| JP | 2002-168170 | | 6/2002 | |
| JP | 2007-211631 | | 8/2007 | |
| JP | 2007-224795 | | 9/2007 | |
| JP | 2007-231927 | | 9/2007 | |
| JP | 2009-052435 | | 3/2009 | |
| JP | 4362675 | | 11/2009 | |
| JP | 2010-101212 | | 5/2010 | |
| JP | 2012-041899 | | 3/2012 | |
| JP | 2012-167665 | | 9/2012 | |
| JP | 2014-206061 | | 10/2014 | |
| JP | 2014-218995 | | 11/2014 | |
| JP | 2014-218997 | | 11/2014 | |
| WO | WO-2012105570 | A1 * | 8/2012 | F02M 27/042 |
| WO | WO-2012130649 | A1 * | 10/2012 | F02P 3/0554 |

OTHER PUBLICATIONS

International Preliminary Report on Patentability (4 pages) dated Oct. 22, 2015, issued in PCT/JP2014/060553 and English translation (10 pages).

* cited by examiner (EXAMPLE 1)

(COMPARATIVE EXAMPLE 2)

DELAY TIME INTERPOLATION MAP

ENERGY INPUT TIME INTERPOLATION MAP (COMPARATIVE EXAMPLE 2)

(EXAMPLE 2)

(COMPARATIVE EXAMPLE 3)

(EXAMPLE 3)

IGNITION CONTROL APPARATUS FOR INTERNAL COMBUSTION ENGINE

This application is the U.S. national phase of International Application No. PCT/JP2014/060553 filed 11 Apr. 2014 which designated the U.S. and claims priority to Japanese Patent Application Nos. 2013-082958, filed 11 Apr. 2013 and 2013-140835 filed 4 Jul. 2013, the entire contents of each of which are hereby incorporated by reference.

TECHNICAL FIELD

The present invention relates to an ignition control apparatus configured to control operation of an ignition which is provided in a cylinder of an internal combustion engine to ignite a fuel-air mixture.

BACKGROUND ART

In a known configuration of this type of ignition control apparatus, multiple discharge is performed to improve a combustion state of a fuel-air mixture. For example, PTL 1 discloses a structure in which discharge is permitted to occur intermittently at a rate of more than once per single combustion stroke. PTL 2 discloses a structure in which two ignition coils are connected in parallel with each other to achieve multiple discharge characteristics of long duration of discharge.

PTL 3 discloses an ignition control apparatus for an internal combustion engine including, in addition to a normal inductive-discharge-type ignition control apparatus, a DC-DC converter that injects ignition energy to a secondary side of the ignition coil, a deactivation means that deactivates the DC-DC converter, and a deactivation cancellation means that cancels the deactivation when a predetermined operating state is detected.

CITATION LIST

Patent Literatures

PTL 1: JP-A-2007-231927
PTL 2: JP-A-2000-199470
PTL 3: JP-A-UM-H02-024066

Technical Problem

However, as in the ignition control apparatus disclosed in PTL 1 where the discharge is permitted to occur intermittently at a rate of more than once per single combustion stroke, a discharge current for ignition is repeatedly cleared to zero between the start and the end of the ignition discharge during the stroke. This may lead to a problem of causing blow-off if the gas flow rate is large in a cylinder, and cause a loss of ignition energy. In the structure of the ignition control apparatus disclosed in PTL 2 in which two ignition coils are arranged in parallel with each other, the discharge current for ignition is not repeatedly cleared to zero between the start and the end of the ignition discharge in a single combustion stroke. However, the structure of this apparatus becomes complicated and the size of the apparatus is increased. Further, the techniques based on conventional art described above also has a problem that energy which greatly exceeds the energy needed for ignition is generated, causing unnecessary power consumption.

Further, in the ignition control apparatus of PTL 3, a high voltage element has to be used in the DC-DC converter disposed on the secondary side of the ignition coil to maintain the discharge. This leads to a problem of increasing the manufacturing cost and the size of the apparatus because of the need for improving voltage resistance and heat radiation performance, as well as a problem of impairing reliability due to the heat generation or the like of the high voltage element.

The present invention, therefore, has been made in view of the above situations, and has an object of providing an ignition control apparatus for an internal combustion engine having excellent mountability and high reliability at low cost.

SUMMARY

An ignition control apparatus according to an embodiment of the present invention is configured to control an operation of an ignition plug. The ignition plug is provided to ignite a fuel-air mixture in a cylinder of an internal combustion engine. The ignition control apparatus of the present invention includes an ignition coil, a DC power source, a first switching element, a second switching element, a third switching element, an energy storing coil, a capacitor, and a control unit.

The ignition coil includes a primary winding and a secondary winding. The secondary winding is connected to the ignition plug. The ignition coil is configured to generate a secondary current in the secondary winding by increase and decrease of a primary current (which is a current passing through the primary winding). The primary winding has one end side to which a non-grounded side output terminal of the DC power source is connected, so as to cause the primary current to pass through the primary winding.

The first switching element includes a first control terminal, a first power source side terminal, and a first grounded side terminal. The first switching element is a semiconductor switching element configured to control turn-on and turn-off of current supply between the first power source side terminal and the first grounded side terminal according to a first control signal inputted to the first control terminal. In the first switching element, the first power source side terminal is connected to the other end side of the primary winding. The first grounded side terminal is connected to the grounded side.

The second switching element includes a second control terminal, a second power source side terminal, and a second grounded side terminal. The second switching element is a semiconductor switching element configured to control turn-on and turn-off of current supply between the second power source side terminal and the second grounded side terminal according to a second control signal inputted to the second control terminal. In the second switching element, the second grounded side terminal is connected to the other end side of the primary winding.

The third switching element includes a third control terminal, a third power source side terminal, and a third grounded side terminal. The third switching element is a semiconductor switching element configured to control turn-on and turn-off of current supply between the third power source side terminal and the third grounded side terminal according to a third control signal inputted to the third control terminal. In the third switching element, the third power source side terminal is connected to the second power source side terminal of the second switching element. The third grounded side terminal is connected to the grounded side.

The energy storing coil is an inductor provided to store energy when the third switching element is turned on. The energy storing coil is interposed on a power line connecting the non-grounded side output terminal of the DC power source to the third power source side terminal of the third switching element.

The capacitor is disposed between the non-grounded side output terminal and the grounded side of the DC power source and connected in series with the energy storing coil. The capacitor is provided to store energy generated by the turn-off of the third switching element.

The control unit is provided to control the second switching element and the third switching element. Specifically, the control unit is configured to control the individual switching elements to supply the primary current to the primary winding from the other end side thereof by discharging (which is performed by turning on the second switching element) the stored energy from the capacitor during the ignition discharge (which is performed by turning off the first switching element) of the ignition plug. In the present invention, the control unit is configured to control the second switching element or the third switching element to provide variability to the amount of stored energy or the amount the stored energy discharged from the capacitor according to the operating state of the internal combustion engine.

First, a typical operation of the ignition control apparatus of the present invention configured as above will be described. The primary current is permitted to pass through the primary winding by turning on the first switching element and turning off the second switching element. Accordingly, the ignition coil is charged. On the other hand, the third switching element is turned on to store energy in the energy storing coil. The stored energy is discharged from the energy storing coil when the third switching element is turned off and stored in the capacitor.

If the first switching element is turned off in a state where the energy is stored in the capacitor and where the second switching element and the third switching element are turned off, the primary current, which has been passed through the primary winding, is quickly interrupted. As a result, a high voltage is generated in the primary winding of the ignition coil, and the high voltage is further boosted by the secondary winding, leading to generation of a high voltage in the ignition plug to start discharge. At this time, a large secondary current is generated in the secondary winding. Thus, the ignition discharge starts in the ignition plug.

After start of ignition discharge in the ignition plug, the secondary current (which will be referred to as discharge current hereinafter), if left as it is, comes close to zero with time. In this regard, in the configuration of the present invention, the stored energy is discharged from the capacitor when the second switching element is turned on during the ignition discharge. Such discharge energy is supplied to the primary winding from the other end side thereof. Then, the primary current is permitted to pass through the primary winding. At this time, an additional current associated with the passage of the primary current is superposed on the discharge current that has been passed so far. Thus, the discharge current can be favorably secured to an extent of maintaining the ignition discharge.

The energy storage state in the capacitor is controlled by turning on/off the second switching element and the third switching element. Specifically, the energy storage amount in the capacitor is controlled by turning on/off the third switching element while the second switching element is turned off. The state of supply of the secondary current during the ignition discharge is appropriately controlled by adjusting the discharge amount of the energy stored in the capacitor by turning on/off the second switching element.

In the ignition control apparatus of the present invention, therefore, the control unit controls the second switching element or the third switching element in such a manner that variability is provided to the amount of stored energy or the amount of stored energy discharged from the capacitor according to the operating state of the internal combustion engine. Thus, it is possible to favorably control the state of supply of the secondary current according to a state of gas flow in the cylinder so as not to cause blow-off.

According to the present invention, as described above, the occurrence of blow-off and a loss of the ignition energy accompanying blow-off can be favorably minimized by a simple configuration of the apparatus. Since the energy is inputted from the low voltage side (grounded side or the first switching side) of the primary winding, it is possible to input the energy at a lower voltage than in the case of inputting the energy from the secondary winding side. In this regard, efficiency would be deteriorated if the energy is inputted from the high voltage side (the DC power source side) of the primary winding at a voltage higher than the voltage of the DC power source, due to flow-in or the like of current into the DC power source. In contrast, according to the present invention, energy can be inputted with the easiest and most effective way because the energy is inputted from the low voltage side of the primary winding.

An ignition control apparatus according to another embodiment of the present invention at least includes: a DC power source; a boosting circuit boosting a power source voltage of the DC power source; an ignition coil increasing and decreasing a current of a primary winding connected to the boosting circuit to generate a high secondary voltage in a secondary winding; and an ignition open/close element switching supply and interruption of current supply to the primary winding according to an ignition signal generated according to an operating state of an engine, the ignition control apparatus being connected to the secondary winding to control an operation of an ignition plug that generates spark discharge in a combustion chamber of an internal combustion engine in response to application of a secondary voltage from the secondary winding. The ignition control apparatus also includes an auxiliary power source that increases the current passing through the secondary winding by performing discharge and non-discharge of current from the boosting circuit in a superposed manner at a connection point between the primary winding and the ignition open/close element, so as to input energy for continuing discharge for a predetermined discharge period, after a lapse of a predetermined delay time following the start of discharge of the ignition plug by the open/close of the ignition open/close element. The ignition control apparatus also includes an auxiliary open/close element that switches between discharge and non-discharge of current from the auxiliary power source, an auxiliary open/close element driving circuit that drives open/close of the auxiliary open/close element, and a delay time calculating unit that delays start of driving of the auxiliary open/close element by a predetermined delay time, from the falling of the ignition signal, according to an engine parameter indicating an operating state of the internal combustion engine.

Specifically, according to the operating state of the internal combustion engine determined on the basis of one or more engine parameters, the delay time calculating unit elongates the delay time for starting the open/close driving of the auxiliary element, as the revolution of the internal combustion engine is decreased or the load of the internal combustion is decreased. The delay time calculating unit also shortens the delay time for starting the open/close driving of the auxiliary element, as the revolution of the internal combustion engine is increased or the load of the internal combustion engine is increased. The engine parameters include an engine speed, an intake pressure, an accelerator opening, a crank angle, a water temperature of the engine, an EGR ratio, an air-fuel ratio, and the primary voltage, the primary current, the secondary voltage, and the secondary current of the ignition coil.

Further, the discharge period for maintaining discharge by the open/close driving of the auxiliary element is shortened, as the revolution of the internal combustion engine is decreased or the load of the internal combustion engine is decreased. The discharge period for maintaining discharge by the open/close driving of the auxiliary open/close element is elongated, as the revolution of the internal combustion engine is increased or the load of the internal combustion engine is increased.

In the ignition control apparatus according to the present invention, it is possible to adjust the open/close timing of the auxiliary open/close element by allowing the delay time calculating unit to calculate an appropriate delay time and a discharge period according to the operating state of the internal combustion engine. Accordingly, the energy to be inputted to the ignition plug from the auxiliary power source can be increased/decreased to thereby minimize waste of input energy, reliably maintain discharge, and realize stable ignition.

DESCRIPTION OF THE EMBODIMENTS

Referring to the accompanying drawings, several embodiments of the present invention will be described below. Modifications of the embodiments are listed in the end of the description of the embodiments, as such modifications may hamper consistent understanding of the embodiments if inserted in the description of the embodiments.

First Embodiment

Referring to FIGS. 1 to 4, a first embodiment of the present invention will be described. This embodiment relates to an ignition control apparatus.

<Engine System Structure>

Figure 1:
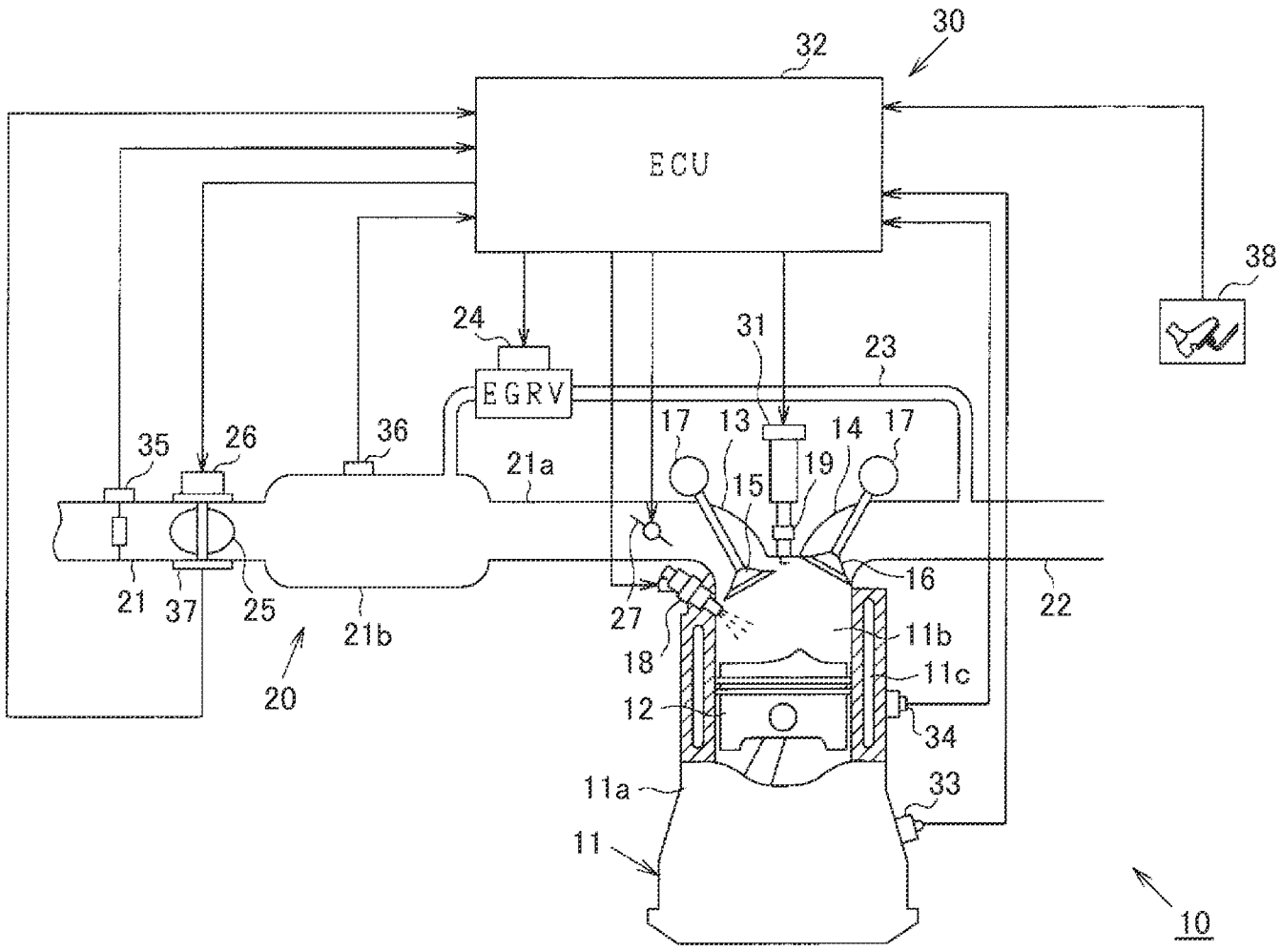
FIG. 1 is a schematic diagram illustrating a configuration of an engine system according to a first embodiment of the present invention.

Referring to FIG. 1, an engine system 10 includes an engine 11 which is a spark ignition type internal combustion engine. In an engine block 11*a* that constitutes a body of the engine 11, a cylinder 11*b* and a water jacket 11*c* are formed. The cylinder 11*b* is provided so as to accommodate a piston 12 in a reciprocating manner. The water jacket 11*c* serves as a space where a cooling liquid (also referred to as cooling water) can flow, and is provided to surround the periphery of the cylinder 11*b*.

In a cylinder head forming a top of the engine block 11*a*, an intake port 13 and an exhaust port 14 are formed so as to be able to communicate with the cylinder 11*b*. The cylinder head is also provided with an intake valve 15 for controlling the communication state between the intake port 13 and the cylinder 11*b*, an exhaust valve 16 for controlling the communication state between the exhaust port 14 and the cylinder 11*b*, and a valve driving mechanism 17 for opening/closing the intake valve 15 and the exhaust valve 16 at predetermined timing.

The engine block 11*a* is mounted with an injector 18 and an ignition plug 19. In the present embodiment, the injector 18 is provided to directly spray fuel in the cylinder 11*b*. The ignition plug 19 is provided to ignite a fuel-air mixture in the cylinder 11*b*.

The engine 11 is connected to a supply/exhaust mechanism 20. The supply/exhaust mechanism 20 includes three gas channels which are an intake pipe 21 (including an intake manifold 21*a* and a surge tank 21*b*), an exhaust pipe 22, and an EGR channel 23.

The intake manifold 21*a* is connected to the intake port 13. The surge tank 21*b* is arranged on an upstream side of the intake manifold 21*a* in an intake gas flowing direction. The exhaust pipe 22 is connected to the exhaust port 14.

The EGR channel 23 connects between the exhaust pipe 22 the surge tank 21*b* to introduce part of the exhaust gas, which has been discharged to the exhaust pipe 22, into the intake gas (EGR stands for exhaust gas recirculation). The EGR channel 23 is interposed by an EGR control valve 24. The EGR control valve 24 is provided so as to be able to control an EGR ratio (mixing ratio of the exhaust gas in a gas to be sucked into the cylinder 11*b* before being combusted) according to an opening thereof.

The intake pipe 21 is interposed by a throttle valve 25 on an upstream side of the surge tank 21*b* in the intake gas flowing direction. In the throttle valve 25, the opening is ensured to be controlled by the operation of a throttle actuator 26, such as a DC motor. In the vicinity of the intake port 13, a gas flow control valve 27 is provided to generate a swirl flow and a tumble flow.

The engine system 10 is provided with an ignition control apparatus 30. The ignition control apparatus 30 is configured to control the operation of the ignition plug 19 (i.e., perform ignition control of the engine 11). The ignition control apparatus 30 includes an ignition circuit unit 31 and an electronic control unit 32.

The ignition circuit unit 31 is configured to allow the ignition plug 19 to generate spark discharge for igniting the fuel-air mixture in the cylinder 11*b*. The electronic control unit 32, that is an engine ECU (which stands for an electronic control unit), is configured to control various portions including the injector 18 and the ignition circuit unit 31 according to the operating state (referred to as engine parameters hereinafter) of the engine 11, which has been acquired based on the outputs of various sensors, such as a revolution speed sensor 33.

As to the ignition control, the electronic control unit 32 is ensured to generate and output an ignition signal IGt and an energy input period signal IGw on the basis of the acquired engine parameters. The ignition signal IGt and the energy input period signal IGw determine an optimal ignition timing and a discharge current (ignition discharge current) according to the state of gas in the cylinder 11*b* and the required output of the engine 11 (which are subject to change according to the engine parameters). These signals are publicly known or well known in the art, and detailed description of these signals will not be provided in this description (see JP-A-2002-168170, JP-A-2007-211631, and the like as needed).

The revolution speed sensor 33 detects (acquires) an engine speed (also referred to as an engine speed) Ne. The revolution speed sensor 33 is mounted to the engine block 11*a* so as to generate a pulsed output according to a revolution angle of the crank shaft, not shown, that which rotated with the reciprocal movement of the piston 12. A cooling water temperature sensor 34 is mounted to the engine block 11*a* to detect (acquire) a water temperature Tw of the cooling liquid that flows through the water jacket 11*c*.

An air flow meter 35 serves as a sensor for detecting (acquiring) an intake air amount Ga (mass flow rate of the intake air introduced into the cylinder 11*b* through the intake pipe 21). The air flow meter 35 is mounted to the air intake pipe 21 on an upstream side of the throttle valve 25 in the intake air flowing direction. An intake pressure sensor 36 is mounted to the surge tank 21*b* to detect (acquire) an intake pressure Pa in the intake pipe 21.

A throttle opening sensor 37 is incorporated in the throttle actuator 26 to generate an output corresponding to an opening (throttle position THA) of the throttle valve 25. An accelerator position sensor 38 is provided to generate an output corresponding to a manipulated variable of the accelerator (accelerator manipulated variable ACCP), not shown.

<Structure of Ignition Control Apparatus>

Figure 2:
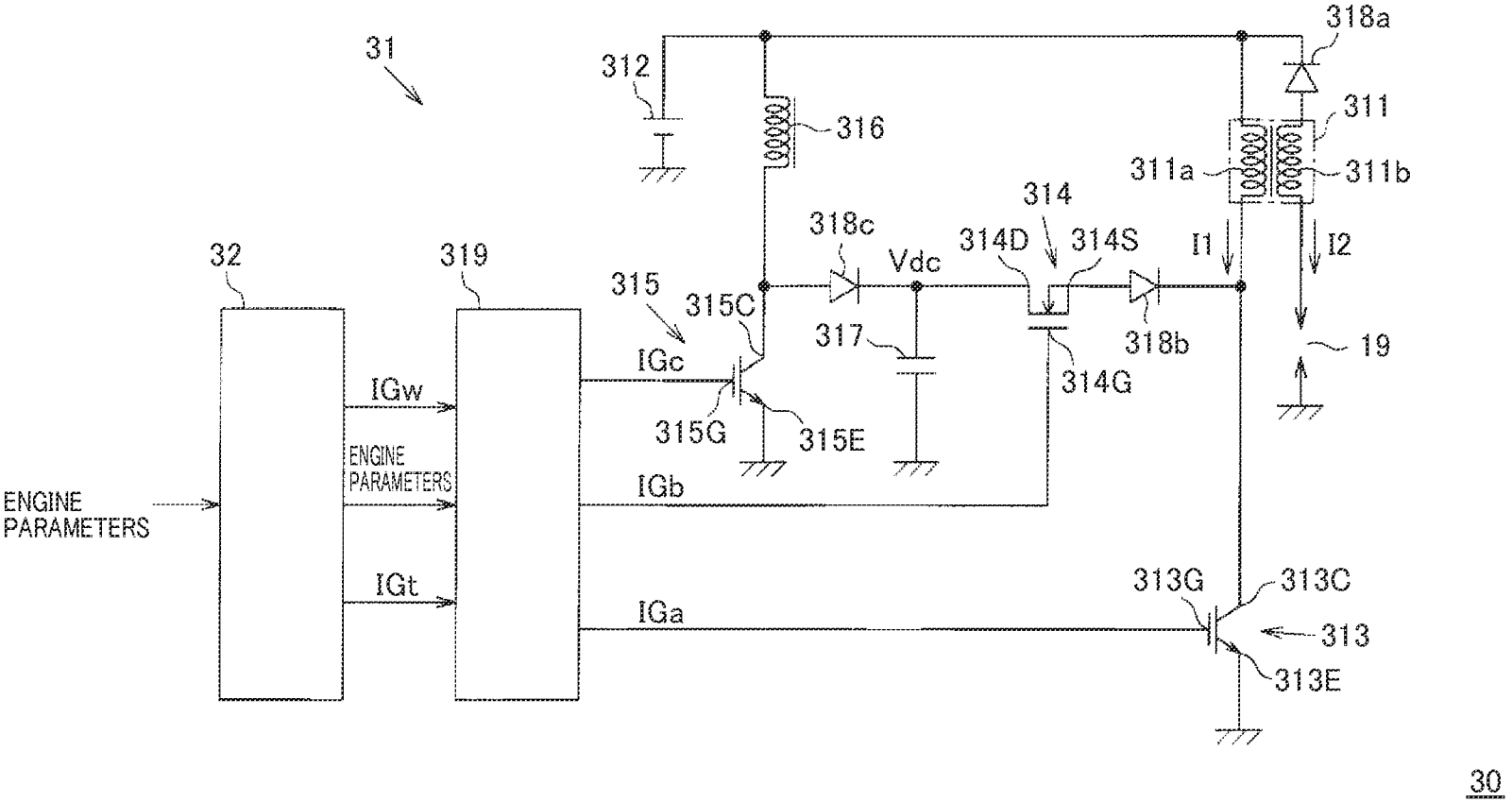
FIG. 2 is a schematic circuit diagram illustrating an ignition control apparatus illustrated in FIG. 1.

Referring to FIG. 2, the ignition circuit unit 31 includes an ignition coil 311 (including a primary winding 311*a* and a secondary winding 311*b*), a DC power source 312, a first switching element 313, a second switching element 314, a third switching element 315, an energy storing coil 316, a capacitor 317, diodes 318*a*, 318*b*, and 318*c*, and a driver circuit 319.

As mentioned above, the ignition coil 311 includes the primary winding 311*a* and the secondary winding 311*b*. The ignition coil 311 is configured, as well known in the art, to generate a secondary current by the secondary winding 311*b* in conformity with an increase/decrease of a primary current passing through the primary winding 311*a*.

The primary winding 311*a* has an end that is a high voltage side terminal (also referred to as a non-grounded side terminal) side which is connected to a non-grounded side output terminal (i.e., positive terminal) of the DC power source 312. On the other hand, the primary winding 311*a* has the other end that is a low voltage side terminal (also referred to as a grounded side terminal) side which is connected to the grounded side via the first switching element 313. That is, the DC power source 312 is provided to allow the primary winding 311*a* to supply the primary current in a direction from the high voltage side terminal side toward the low voltage side terminal side when the first switching element 313 is turned on.

The secondary winding 311*b* has a high voltage side terminal (also referred to as a non-grounded side terminal) side which is connected to the high voltage side terminal side of the primary winding 311*a* via the diode 318*a*. The diode 318*a* has an anode connected to the high voltage side terminal side of the secondary winding 311*b* so as to prevent the current from passing in a direction from the high voltage side terminal side of the primary winding 311*a* toward the high voltage side terminal side of the secondary winding 311*b*, and regulate the secondary current (discharge current) so as to be passed from the ignition plug 19 toward the secondary winding 311*b* (i.e., so that a current I2 in the drawing has a negative value). On the other hand, the secondary winding 311*b* has a low voltage side terminal (also referred to as the grounded side terminal) side which is connected to the ignition plug 19.

The first switching element 313 is an IGBT (which stands for an insulated gate bipolar transistor) that is a MOS gate structure transistor, and includes a first control terminal 313G, a first power source side terminal 313C, and a first grounded side terminal 313E. The first switching element 313 is configured to control turn-on and turn-off of current supply between the first power source side terminal 313C and the first grounded side terminal 313E on the basis of a first control signal IGa that inputted to the first control terminal 313G. In the present embodiment, the first power source side terminal 313C is connected to the low voltage side terminal side of the primary winding 311*a*. The first grounded side terminal 313E is connected to the grounded side.

The second switching element 314 is a MOSFET (which stands for a metal oxide semiconductor field effect transistor), and includes a second control terminal 314G, a second power source side terminal 314D, a second grounded side terminal 314S. The second switching element 314 is configured to control turn-on and turn-off of current supply between the second power source side terminal 314D and the second grounded side terminal 314S on the basis of a second control signal IGb that is inputted to the second control terminal 314G.

In the present embodiment, the second grounded side terminal 314S is connected to the low voltage side terminal side of the primary winding 311*a* via the diode 318*b*. The diode 318*b* has an anode connected to the second grounded side terminal 314S so as to allow passage of current in a direction from the second grounded side terminal 314S of the second switching element 314 toward the low voltage side terminal side of the primary winding 311*a*.

The third switching element 315 is an IGBT that is a MOS gate structure transistor, and includes a third control terminal 315G, a third power source side terminal 315C, a third grounded side terminal 315E. The third switching element 315 is configured to control turn-on and turn-off of current supply between the third power source side terminal 315C and the third grounded side terminal 315E on the basis of a third control signal IGc inputted to the third control terminal 315G. The third switching element 315 may be a power transistor, such as a thyristor, other than the IGBT.

In the present embodiment, the third power source side terminal 315C is connected to the second power source side terminal 314D of the second switching element 314 via the diode 318*c*. The diode 318*c* has an anode connected to the third power source side terminal 315C so as to allow passage of current in a direction from the third power source side terminal 315C of the third switching element 315 toward the second power source side terminal 314D of the second switching element 314. The third grounded side terminal 315E of the third switching element 315 is connected to the grounded side.

The energy storing coil 316 is an inductor provided to store energy when the third switching element 315 is turned on. The energy storing coil 316 is interposed in a power line connecting the non-grounded side output terminal, mentioned above, of the DC power source 312 and the third power source side terminal 315C of the third switching element 315.

The capacitor 317 is connected in series with the energy storing coil 316 on a line connecting between the grounded side and the non-grounded side output terminal, mentioned above, of the DC power source 312. That is, the capacitor 317 is connected in parallel with the third switching element 315 relative to the energy storing coil 316. The capacitor 317 is provided to store energy when the third switching element 315 is turned off.

The driver circuit 319 that constitutes a control unit of present invention is connected to the electronic control unit 32 so as to receive the engine parameters outputted from the electronic control unit 32, the ignition signal IGt, and the energy input period signal IGw. The driver circuit 319 is also connected to the first control terminal 313G, the second control terminal 314G, and the third control terminal 315G so as to control the first switching element 313, the second switching element 314, and the third switching element 315, respectively. The driver circuit 319 is provided to output the first control signal IGa, the second control signal IGb, and the third control signal IGc to the first control terminal 313G, the second control terminal 314G, and the third control terminal 315G, respectively, on the basis of the received ignition signal IGt and the energy input period signal IGw.

Specifically, the driver circuit 319 is ensured to discharge the stored energy from the capacitor 317 (which is performed upon turn-on of the second switching element 314) during the ignition discharge of the ignition plug 19 (which is started upon turn-off of the first switching element 313). Thus, the driver circuit 319 is ensured to control the switching elements so as to supply the primary current to the primary winding 311*a* from the low voltage side terminal side of the primary winding 311*a*. In particular, the driver circuit 319 of the present embodiment is ensured to control the second switching element 314 and the third switching element 315 so as to provide variability to the amount of storage energy or the amount of stored energy discharged from the capacitor 317 according to the engine parameters.

<Description of Operation>

An operation (actions and effects) of the configuration of the present embodiment will be described below. In the timing charts of FIGS. 3 and 4, Vdc represents a voltage of the capacitor 317, I1 represents the primary current, I2 represents the secondary current, and P represents energy (referred to as input energy hereinafter) that is discharged from the capacitor 317 and supplied to the primary winding 311*a* from its low voltage side terminal side.

In the timing charts of the primary current I1 and the secondary current I2, it is assumed that the directions indicated by the arrows in FIG. 2 represent positive values. The timing chart of the input energy P indicates an accumulated value of the input energy from the start of current supply (the first rising of the second control signal IGb) in a single ignition. Further, in the ignition signal IGt, the energy input period signal IGw, the first control signal IGa, the second control signal IGb, and the third control signal IGc, H is taken as a state where the signal rises upward in the chart, and L is taken as a state where the signal falls downward in the chart.

The electronic control unit 32 controls the operation of various portions of the engine system 10, which includes the injector 18 and the ignition circuit unit 31, according to the engine parameters that have been acquired based on the outputs of the various sensors, such as the revolution speed sensor 33. The ignition control will be described in detail. The electronic control unit 32 generates the ignition signal IGt and the energy input period signal IGw on the basis of the acquired engine parameters. The electronic control unit 32 then outputs the generated ignition signal IGt and the energy input period signal IGw as well as the engine parameters to the driver circuit 319.

Upon reception of the ignition signal IGt, the energy input period signal IGw, and the engine parameters, which have been outputted from the electronic control unit 32, the driver circuit 319 outputs the first control signal IGa for controlling the turn-on and turn-off of the first switching element 313, the second control signal IGb for controlling the turn-on and turn-off of the second switching element 314, and the third control signal IGc for controlling the turn-on and turn-off of the third switching element 315.

In the present embodiment, the first control signal IGa and the ignition signal IGt are identical. Therefore, the driver circuit 319 outputs the received ignition signal IGt as it is to the first control terminal 313G of the first switching element 313.

On the other hand, the second control signal IGb is generated based on the received energy input period signal IGw. Therefore, the driver circuit 319 generates the second control signal IGb on the basis of the energy input period IGw, and outputs the second control signal IGb to the second control terminal 314G of the second switching element 314. In the present embodiment, the second control signal IGb is a rectangular-wave pulsed signal having a fixed cycle and a fixed on-duty ratio (1:1) and outputted repeatedly while the energy input period signal IGw is at the H level.

The third control signal IGc is generated based on the received ignition signal IGt and the engine parameters. Therefore, the driver circuit 319 generates the third control signal IGc on the basis of the received ignition signal IGt and the engine parameters, and outputs the third control signal IGc to the third control terminal 315G of the third switching element 315. In the present embodiment, the third control signal IGc is a rectangular-wave pulsed signal having a fixed cycle and a variable on-duty ratio conforming to the engine parameters, and outputted repeatedly while the ignition signal IGt is at the H level.

Figure 3:
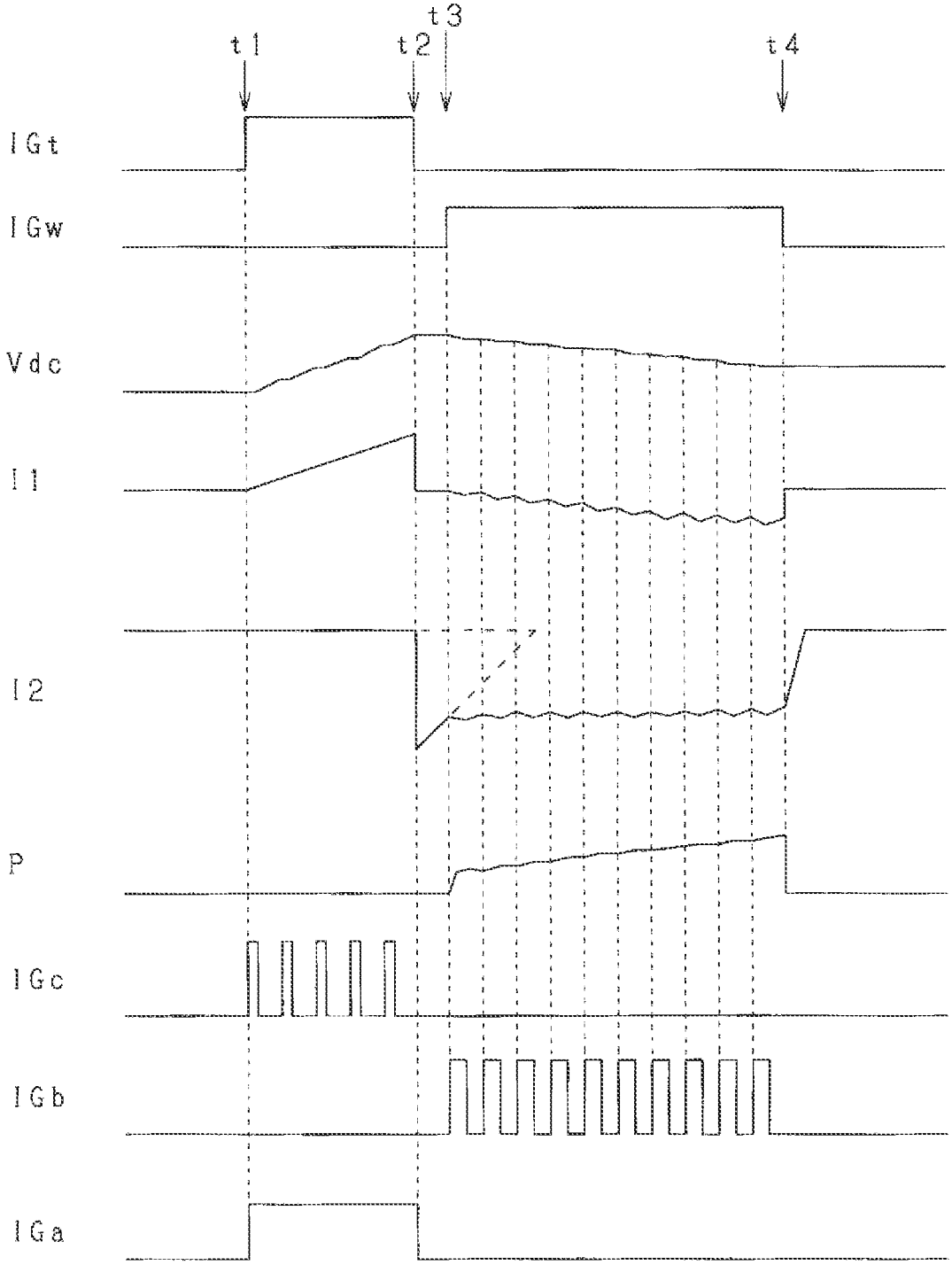
FIG. 3 is a timing chart illustrating an operation of the ignition control apparatus illustrated in FIG. 2.

Referring to FIG. 3, when the ignition signal IGt rises to the H level at time t1, the first control signal IGa rises correspondingly to the H level, and the first switching element 313 is turned on (at this time, the second switching element 314 is in the off-state because the energy input period signal IGw is at the L level). As a result, supply of the primary current to the primary winding 311*a* is started.

While the ignition signal IGt is at the H level, the rectangular-wave pulsed third control signal IGc is inputted to the third control terminal 315G of the third switching element 315. Then, the voltage Vdc increases stepwise during the off period (i.e., during the L level period of the third control signal IGc) after the turn-on of the third switching element 315 in the on/off operation.

Thus, the ignition coil 311 is charged during times t1 to t2 when the ignition signal IGt is at the H level, and the energy is accumulated in the capacitor 317 via the energy storing coil 316. The accumulation of energy is finished by time t2.

After that, at time t2, the first control signal IGa is permitted to fall from the H level to the L level to turn off the first switching element 313, to thereby quickly interrupt the primary current that has been supplied so far through the primary winding 311*a*. Then, a discharge current, which is a large secondary current, is generated in the secondary winding 311*b* of the ignition coil 311. As a result, the ignition discharge starts in the ignition plug 19.

After start of ignition discharge at time t2, the conventional discharge control (or the operation under the condition where the energy input period signal IGw is maintained at the L level without being raised to the H level) is performed as follows. Specifically, the discharged current, as indicated by a broken line, if left as it is, comes close to zero with time, and is attenuated to such an extent of not being able to maintain the current discharge, finally ending the discharge.

In contrast, in the present example of operation, the energy input period signal IGw is raised to the H level at time t3 immediately after time t2 to turn on the second switching element 314 (the second control signal IGb=H level) while the third switching element 315 is turned off (the third control signal IGc=L level). Accordingly, the accumulated energy in the capacitor 317 is discharged from the capacitor 317, and the input energy described above is supplied to the primary winding 311*a* from the low voltage side terminal side. As a result, the primary current, which is caused by the input energy, is permitted to pass through the primary winding 311*a* during the ignition discharge.

At this time, an additional current associated with the supply of the primary current caused by the input energy is superposed on the discharge current that is supplied between times t2 to t3. Such a superposition (addition) of the temporary current is performed every time the second switching element 314 is turned on from time t3 onward (until t4). That is, as illustrated in FIG. 3, the primary current (I1) is sequentially provided with additional current by the accumulated energy of the capacitor 317 every time the second control signal IGb is raised. In response to this, the discharge current (I2) is sequentially provided with additional current. Thus, the discharge current is secured well to such an extent that the ignition discharge can be maintained. In this specific example, the time interval between time t2 and t3 is appropriately set (using a map or the like) by the electronic control unit 32 on the basis of the engine speed Ne and the intake air amount Ga, so as not to cause blow-off.

The energy accumulation state of the capacitor 317 from times t1 to t2 where the ignition signal IGt is raised to the H level is controllable according to the on-duty ratio of the third control signal IGc. As the accumulated energy of the capacitor 317 is increased, the energy to be inputted every time the second switching element 314 is turned on is also increased.

Figure 4:
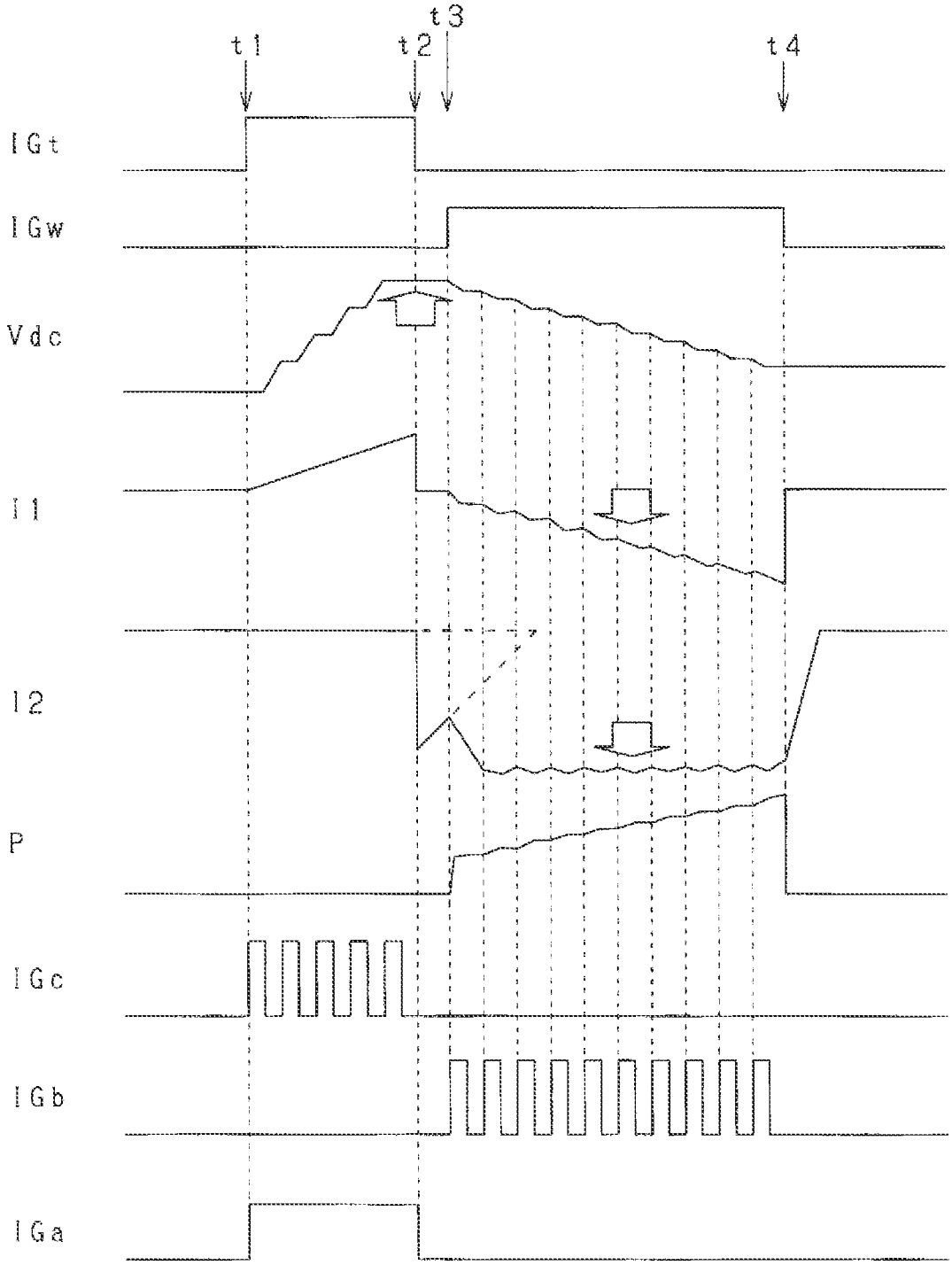
FIG. 4 is a timing chart illustrating an operation of the ignition control apparatus illustrated in FIG. 2.

In the present embodiment, therefore, the third control signal IGc is set to a higher on-duty ratio, as the load becomes larger or the operation is performed with higher revolution (the intake pressure Pa: high, the engine speed Ne: high, the throttle position THA: large, the EGR ratio: high, the air-fuel ratio: lean), under which blow-off is likely to occur. Thus, the energy storage amount in the capacitor 317 and the input energy can be increased, as illustrated in FIG. 4 (see the arrows in FIG. 4 in particular), according to the operating state of the engine. Blow-off can thus be favorably mitigated while reducing the power consumption in the capacitor 317.

As describe above, in the configuration of the present embodiment, the state of supply of the discharge current can be well controlled in response to the state of supply of the gas in the cylinder 11*b*, so as not to cause blow-off. According to the present embodiment, therefore, the occurrence of blow-off and loss of the ignition energy accompanying blow-off can be favorably mitigated with a simple configuration of the apparatus.

Specifically, as in the configuration of the present embodiment, by inputting the energy from the low voltage side terminal side (first switching 313 side) of the primary winding 311*a*, the energy can be inputted at a lower voltage than in the case of inputting the energy from the secondary winding 311*b* side. If the energy is inputted at a higher voltage than the voltage of the DC power source 312 from the high voltage side terminal of the primary winding 311*a*, the efficiency is deteriorated due to, for example, the flow of the current into the DC power source 312. In contrast, the configuration of the present embodiment has an excellent advantageous effect that the energy can be inputted in the easiest and most efficient way, because the energy is inputted from the low voltage side terminal side of the primary winding 311*a*.

<Modifications>

Representative modifications will be described below. In the following description of the modifications, the same reference signs may be used for portions having the same configuration and functions as those described in the embodiment described above. Such portions will be described below by appropriately using, by reference, part of the above description of the embodiment within a range not technically contradicted. Needless to say, however, the modifications are not limited to those listed below. Part of the embodiment described above, and all or part of the modifications described below can be appropriately applied in combination within a range not technically contradicted.

The present invention is not limited to the configuration specifically illustrated in the above embodiment. For example, part of the functional blocks of the electronic control unit 32 may be integrated with the driver circuit 319. Alternatively, the driver circuit 319 may be divided on a switching element basis. In this case, when the first control signal IGa is identical with the ignition signal IGt, the ignition signal IGt may be directly outputted to the first control terminal 313G of the first switching element 313 from the electronic control unit 32 without passing through the driver circuit 319.

The IGa signal and the IGc signal do not have to be necessarily coincidentally generated. For example, in the driver circuit 319, the IGc signal alone may be generated and outputted first in synchrony with the rising of the IGt signal, and the IGa signal may then be outputted after being delayed for a while. That is, the IGa signal may be delayed from the IGc signal. This leads to an increase of energy to be stored in the capacitor 317. Alternatively, the IGc signal may be delayed from the IGa signal.

The present invention is not limited to specific operations exemplified in the embodiment described above. For example, the control parameters may be arbitrarily selected for use from the intake pressure Pa, the engine speed Ne, the throttle position THA, the EGR ratio, the air-fuel ratio, which have been described above, as well as other engine parameters, such as the intake air amount Ga and the accelerator manipulated variable ACCP. Instead of the engine parameters, other information that can be used for generation of the second control signal IGb and the third control signal IGc may be outputted to the driver circuit 319 from the electronic control unit 32.

The input energy may be made variable by controlling the waveform of the energy input period signal IGw (at the rising timing at t3 and/or in the period between t3 to t4 illustrated in FIG. 3 or the like), instead of, or in addition to, controlling the duty of the third control signal IGc exemplified in the above embodiment. In this case, the electronic control unit 32 corresponds to the control unit of the present invention instead of, or in addition to, the driver circuit 319.

Second Embodiment

Referring to FIGS. 5 to 10, a second embodiment of the present invention will be described below.

Figure 5:
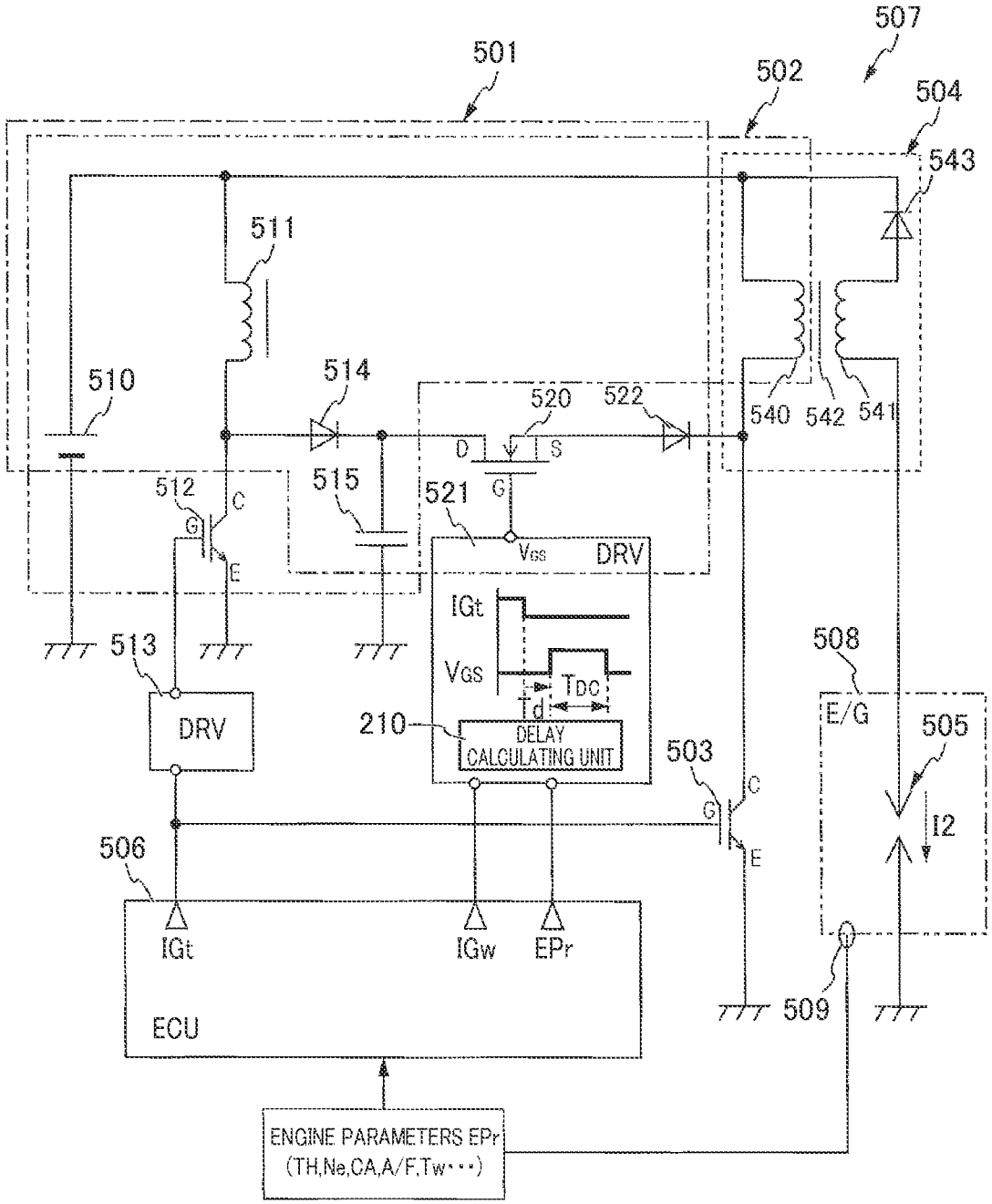
FIG. 5 is a schematic diagram illustrating a configuration of an ignition control apparatus according to a second embodiment of the present invention.

Referring to FIG. 5, the outline of an ignition control apparatus 507 in the second embodiment of the present invention will be described.

The ignition control apparatus 507 of the present invention is provided for each cylinder, not shown, of an internal combustion engine 508 to generate spark discharge in the fuel-air mixture introduced into the combustion chamber for ignition.

The ignition control apparatus 507 includes a boosting circuit 501, an auxiliary power source 502, an ignition open/close element 503, an ignition coil 504, and an externally provided engine control unit 506 (referred to as an ECU 506 hereinafter).

The boosting circuit 501 includes an energy storing inductor 511 (referred to as an inductor 511 hereinafter) connected to a power source 510, a boosting open/close element 512 (referred to as a boosting element 512 hereinafter) that switches supply and interruption of the current passed to the inductor 511 at a predetermined cycle, a capacitor 515 connected parallel to the inductor 511, a first rectifying element 514 that rectifies the current passed from the inductor 511 to the capacitor 515, and a primary winding 540 of the ignition coil 504. The boosting circuit 501 is thus formed as a flyback-type boosting circuit.

The DC power source 510 (referred to as power source 510 hereinafter) is, for example, a vehicle battery or a known DC stabilized power source, in which an AC power source is converted into a DC power source by a regulator or the like, to supply a fixed DC voltage, such as 12 V or 24 V.

The present embodiment is described by way of an example of using a flyback-type boosting circuit as the boosting circuit 501. However, not being limited to this, a chopper-type boosting circuit may also be used.

As the inductor 511, a coil with a core having a predetermined inductance (L0 which is 5 to 50 p H, for example) or the like is used.

As the boosting element 512, a power transistor, such as a thyristor, an IGBT (insulated gate bipolar transistor) or the like is used.

The boosting element 512 is connected to a boosting element driving driver (referred to as driver 513 hereinafter) is connected to.

The ignition signal IGt is supplied to the driver 513 from the engine control unit 506 (referred to as ECU 506 hereinafter) according to the operating state of the engine.

The driver 513 generates a driving pulse VGS which can switch between high and low, at predetermined timing for a predetermined period, and with a predetermined cycle according to the ignition signal IGt.

When the driving pulse VGS is applied to the gate G of the boosting element 512 from the driver 513, the turn-on and turn-off of the boosting element 512 are switched.

A capacitor having a predetermined capacitance (C which is 100 to 1,000 μF, for example) is used as the capacitor 515.

The rectifying element 514 is served by a diode that prevents back-flow of the current from the capacitor 515 to the inductor 511.

When the boosting element 512 is opened/closed by the driver 513 according to the ignition signal IGt transmitted from the ECU 506, the capacitor 515 is charged with the electric energy stored in the inductor 511 from the power source 510 in a superposed manner to boost a charge/discharge voltage Vdc of the capacitor 515 to a voltage higher than the voltage of the power source (e.g., 50 V to several hundred volts).

The ignition coil 504 includes the primary winding 540 formed by turning a coil wire N1 times, a secondary winding 541 formed by turning a coil wire N2 times, a coil core 542, and a diode 543.

The primary winding 540 of the ignition coil 504 is applied with a voltage of the power source 510 to increase/decrease the current passing through the primary winding 540. Resultantly, a secondary voltage V2, which is a high voltage (e.g., −20 to −50 kV) determined by the ratio N2/N1 of the numbers of coil turns, is generated in the secondary winding 541.

The ignition open/close element 503 (referred to as ignition element 503 hereinafter) is served by a power transistor PTr, such as a MOSFET, IGBT, or the like.

The ignition element 503 switches between supply and interruption of the current passed to the primary winding 540 according to the ignition signal IGt transmitted from the ECU 506 according to the operating state of the engine.

When the current supply to the primary winding 540 is interrupted by the switching of the ignition element 503, a magnetic field changes abruptly and an extremely high secondary voltage V2 is generated in the secondary winding 541 by electromagnetic induction and applied to the ignition plug 505.

The auxiliary power source 502 includes an auxiliary open/close element 520 (referred to as auxiliary element 520 hereinafter) interposed between the capacitor 515 and the primary winding 540, an auxiliary open/close element driving circuit 521 (referred to as driver 521 hereinafter) that drives the auxiliary element 520, a second rectifying element 522, the power source 510, the inductor 511, and the capacitor 515.

The driver 521 of the present embodiment includes a delay time calculating unit 210 serving as a crucial part of the present invention.

Using an interpolation method described later, the delay time calculating unit 210 calculates a delay time Td and a discharge period TDC according to engine parameters EPr indicating the operating state of the internal combustion engine E/G. The delay time Td is used for delaying the start of driving of the auxiliary element 520 from the end position (fall) of the ignition signal IGt.

The driver 521 is incorporated with a timer that counts the delay time Td and the discharge period TDC in synchronism with the falling of the ignition signal IGt.

Upon application of the secondary voltage V2 from the ignition coil 504, discharge is started and, after a lapse of the predetermined delay time Td calculated by the delay time calculating unit 210, the driving pulse VGS is outputted from the driver 521 for the predetermined discharge period TDC to drive the auxiliary element 520.

After start of the discharge of the ignition plug 505 by the open/close of the ignition open/close element 503 and after a lapse of the predetermined delay time Td, the auxiliary power source 502 performs as follows. Specifically, the auxiliary power source 502 performs discharge and non-discharge of current from the boosting circuit 501 in the superposed manner at the connection point between the primary winding 540 and the ignition open/close element 503 for the input of energy to thereby maintain the discharge for the predetermined discharge period TDC. Thus, the current passing through the secondary winding 541 is increased.

According to the open/close driving of the auxiliary element 520, the discharge energy from the auxiliary power source 502 is inputted to the driver 521. By performing discharge and non-discharge of current from the auxiliary power source 502 in a superposed manner, the secondary current I2 passing through the secondary winding 541 can be increased.

As the auxiliary element 520, a power transistor, such as a MOSFET, having high responsiveness is used.

The second rectifying element 522 is served by a diode to rectify the current to be supplied to the primary winding 540 from the capacitor 515.

As the engine parameters EPr, one or more parameters are used, which are selected from the engine speed Ne, the intake pressure PIN, the accelerator opening Th, the crank angle CA, the water temperature Tw of the engine, the EGR ratio, the air-fuel ratio A/F, and the like.

The delay time Td and the discharge period TDC are interpolated for the input of energy. The interpolation is performed according to a map, described later, from which the operating state of the internal combustion engine can be figured out based on the engine parameters EPr to prevent occurrence of blow-off.

In the configuration of the present embodiment, the engine parameters EPr are detected by operating state confirming units 509, not shown, provided to the internal combustion engine 508, the units 509 including the engine speed sensor, the intake pressure sensor, the accelerator opening meter, the crank angle sensor, the engine water temperature sensor, the EGR sensor, and the A/F sensor. Further, in the configuration, the detected engine parameters EPr are indirectly transmitted to the delay time calculating unit 210 via the ECU 506. Alternative to this configuration, the information from the operating state confirming unit 509 may be directly inputted to the delay time calculating unit 210. Alternatively, the voltage V1 and the current I1 of the primary coil, or the discharge voltage V2 and the current I2 of the secondary coil, which are highly correlated to the combustion state of the engine, may be added to the parameters.

By having the auxiliary element 520 switched between discharge and non-discharge of current from the capacitor 515, the current is permitted to pass through to the primary winding 540 and the current and voltage generated in the secondary winding 541 are enhanced, thereby minimizing the occurrence of blow-off.

Thus, after start of discharge with the application of the secondary voltage V2 from the ignition coil 504, the delay time calculating unit 210 is permitted to perform energy input from the auxiliary power source 502, being delayed appropriately by the delay time Td, according to the operating state of the internal combustion engine. With this configuration, energy-saving and stable ignition can be realized.

Since the energy is inputted from the primary winding 540 of the ignition coil 504, the energy can be inputted at a lower voltage than in the case of inputting the energy from the secondary winding 541 side.

Figure 6A:
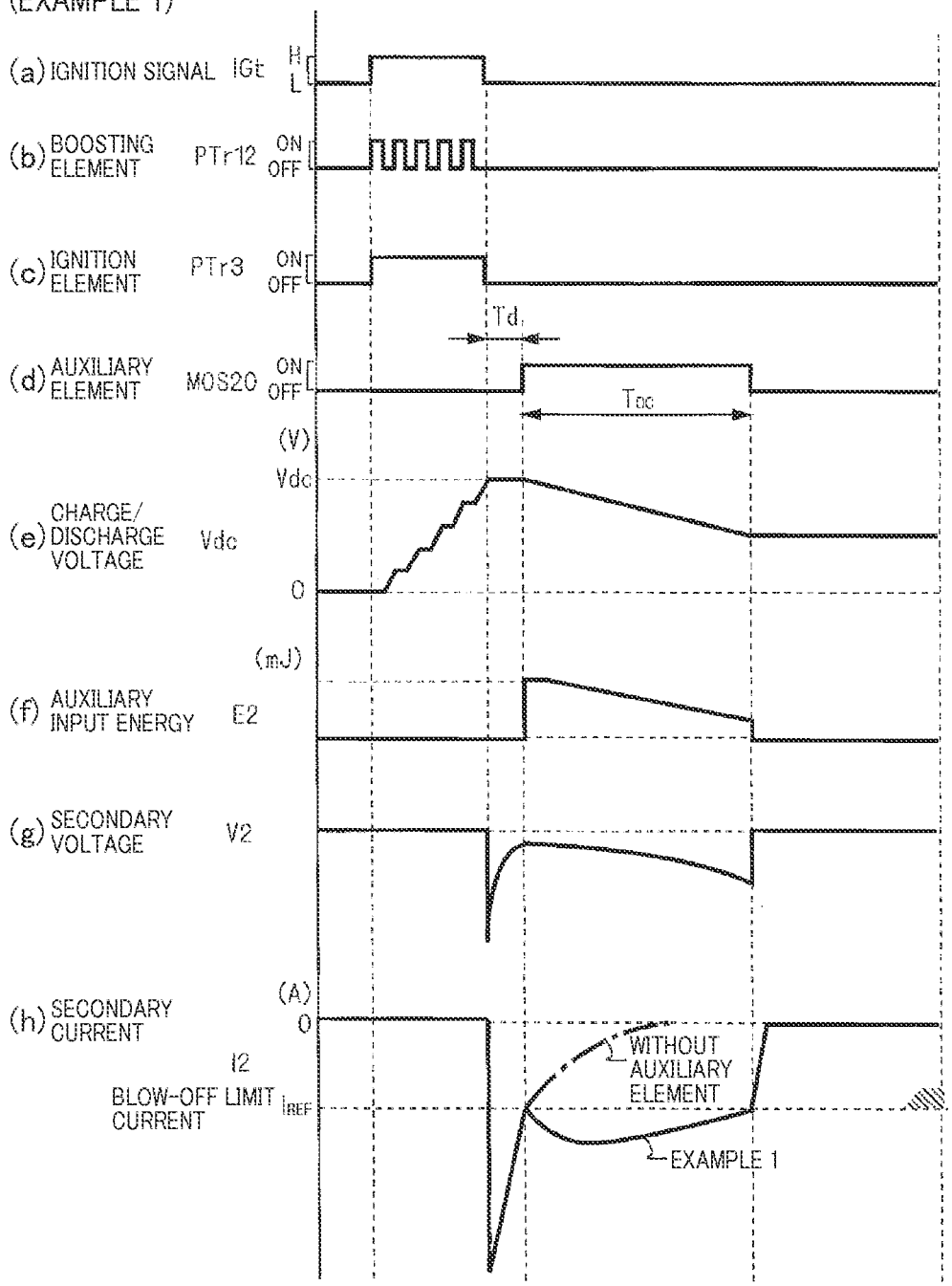
FIG. 6A is a timing chart illustrating an operation of the ignition control apparatus of FIG. 5 illustrated as Example 1.
Figure 6B:
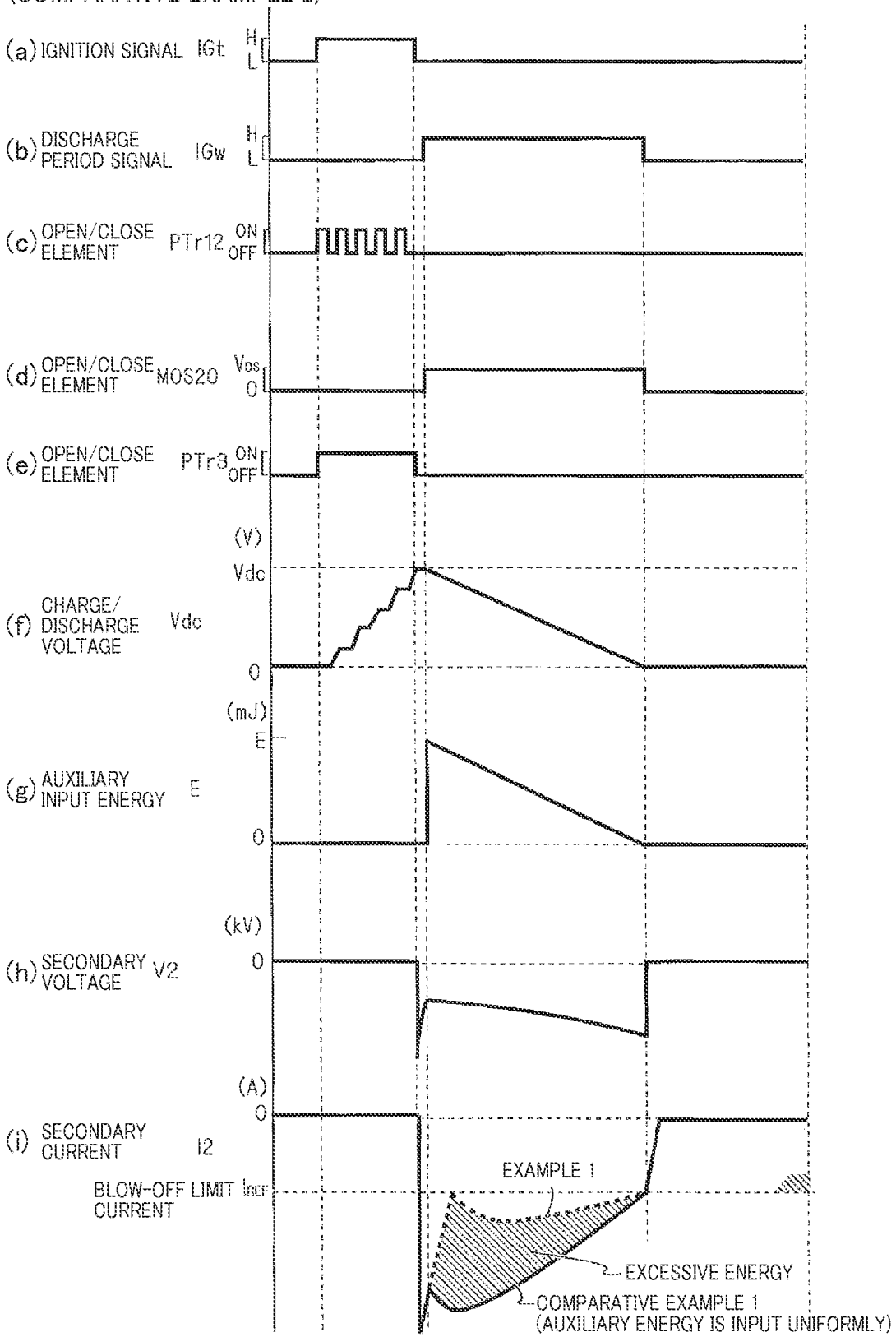
FIG. 6B is a timing chart illustrating an operation of an ignition control apparatus illustrated as Comparative Example 1 in which a delay time calculating unit that represents a crucial part of the present invention is not included.

Referring to FIG. 6A illustrating an Example 1, the operation of the ignition control apparatus 507 of the present invention will be described. Also, referring to FIG. 6B illustrating a Comparative Example 1, problems of the crucial part of the present invention in the absence of the delay time calculating unit 210 will be described.

As indicated by (a) of FIG. 6A, the ignition signal IGt is transmitted from the ECU 506. As indicated by (b) of the figure, the boosting element 512 is repeatedly turned on and off at a predetermined cycle in synchronism with the rising of the ignition signal IGt, while the ignition element 503 is turned on as shown indicated by (c) of the figure.

By the open/close of the boosting element 512, the capacitor 515 is charged with the electric energy from the inductor 511 and thus the charge/discharge voltage Vdc is gradually increased as indicated by (e) of the drawing.

In synchronism with the falling of the ignition signal IGt, the driving of the boosting element 512 is stopped and, at the same time, the ignition element 503 is also stopped.

At this time, as indicated by (g) of the drawing, a high secondary voltage V2 is generated on the side of the secondary winding 541 of the ignition coil 504 and applied to the ignition plug 505.

The application of the secondary voltage V2 causes discharge between electrodes of the ignition plug 505 to thereby instantaneously generate an extremely large secondary current I2 that flows as indicated by (h) of the drawing.

At this time, in the conventional spark ignition control apparatus, the secondary current I2 is quickly decreased, followed by breaking the discharge path across the electrodes, and then the secondary current I2 is no longer passed, as indicated by (h) of the figure as Comparative Example 1 by a dash-dot line.

In the present invention, however, as indicated by (d) of the figure, after a lapse of the predetermined delay time td from the falling of the ignition signal IGt, the auxiliary element 520 is turned on for a predetermined discharge period TDC to start discharge from the capacitor 515 that has been charged with high voltage, as indicated by (e) of the figure. Thus, a large amount of energy is inputted from the auxiliary power source 502 as indicated by (f) of the figure.

As indicated by (f) of the figure, the delay time Td is provided immediately before the secondary current I2 drops below a limit current IREF at which blow-off of the secondary current I2 occurs.

Thus, energy input at the beginning of the discharge can be minimized, while the inputting energy can be maintained in the vicinity of the limit current. As a result, the secondary current I2 can be maintained at the blow-off limit current IREF or more, thereby maintaining the discharge path and improving ignitability.

The secondary current I2 is proportional to the amount of energy inputted from the auxiliary power source 502, and can be appropriately increased/decreased in a range of not causing blow-off according to the condition of the engine, and can be adjusted according to map data described later.

Referring to FIG. 6B which is illustrated as Comparative Example 1, problems of not using the delay time calculating unit 210, which is the crucial part of the present invention, will be described.

Comparative Example 1 differs from Example 1 in that the delay time calculating unit 210 is not provided. Accordingly, the energy from the auxiliary power source 502 is inputted promptly after start of discharge, according to the discharge period signal IGw sent from the ECU 506.

Comparative Example 1 shows that the energy is inputted in response to the IGw signal long time before the secondary current I2 drops below the blow-off limit current IREF.

In this case, as indicated by (i) of the figure, the discharge can be maintained but the inputted energy is wasted and wearing of the electrodes is accelerated due to the excessive input energy exceeding the limit of blow-off.

Figure 7:
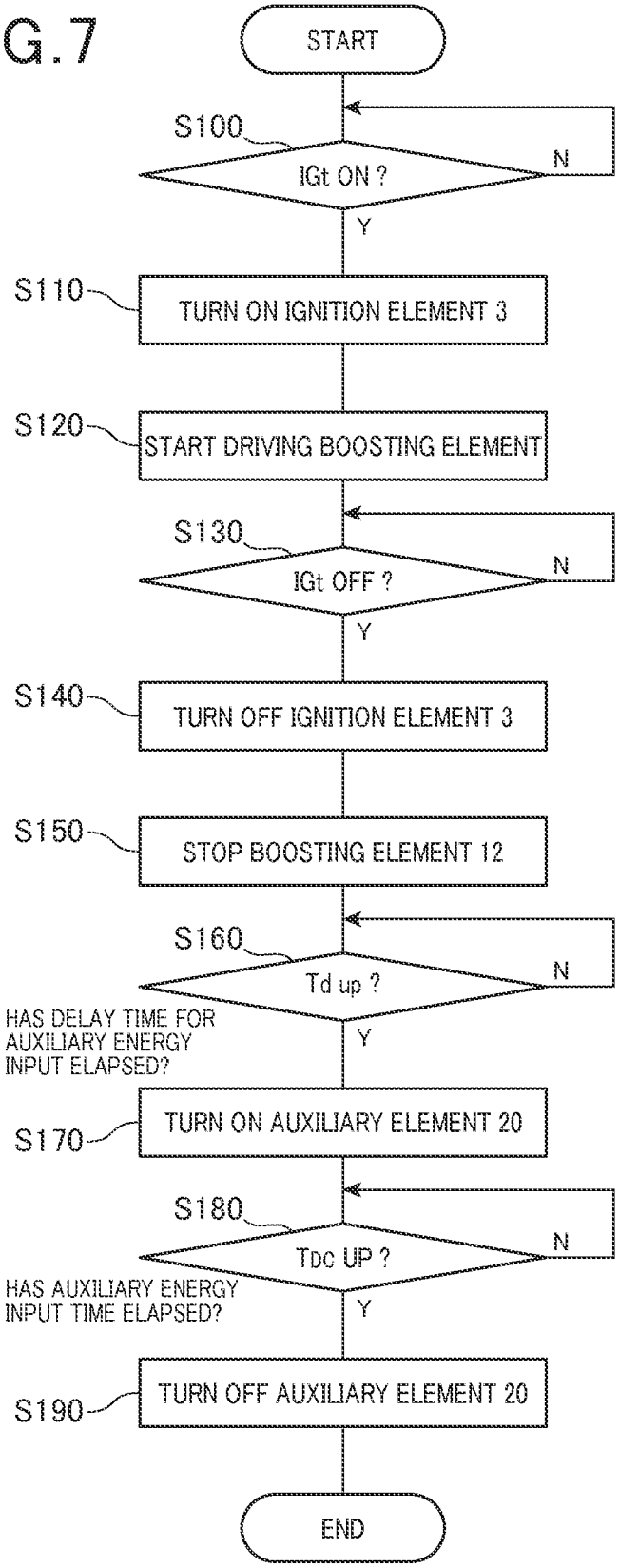
FIG. 7 is a flowchart illustrating a control method applied to the present invention.

Referring to FIG. 7, an example of a discharge control method performed by the ignition control apparatus 507 of the present invention will be described.

The control program can be stored in a control IC or the like that configures the driver 521.

At step S100 of determining startup, it is determined whether the ignition signal IGt sent from the ECU 506 has risen or not, according to the operating state of the internal combustion engine 508.

If the ignition signal IGt is turned off, the determination is No and step S100 is repeated until the rising of the ignition signal IGt is detected.

When the rising of the ignition signal IGt is detected, the determination is Yes, and the process proceeds to step S110.

At step S110 of driving the ignition element, the ignition element 503 is turned on.

At the same time, the process proceeds to step S120 of starting driving of the boosting element to start open/close driving of the boosting element 512.

At the step S130 of determining the falling of the ignition signal, it is determined whether the ignition signal IGt has fallen or not.

Until the falling of the ignition signal IGt is detected, the determination is No and step S130 is repeated.

Meanwhile, the open/close driving of the boosting element 512 is repeated to charge the boosting capacitor 515.

When the falling of the ignition signal IGt is detected at step S130, the determination is Yes and the process proceeds to step S140.

At step S140 of stopping the ignition element, the ignition element 503 is turned off.

At the same time, the process proceeds to step 150 of stopping boosting element to also turn off the boosting element 512.

As a result, an abrupt change occurs in the current passing through the primary winding 540 of the ignition coil 504 and an extremely high secondary voltage V2 is generated by the electromagnetic induction on the secondary winding 541 side. Thus, the insulation across the electrodes of the ignition plug 505 breaks down and discharge is started.

Subsequently, at step S160 of determining the delay time, it is determined whether the delay time Td has elapsed in which counting has been started in synchronism with the falling of the ignition signal IGt. Until the delay time Td elapses, the determination is No and step S160 is repeated. That is, until the delay time Td elapses, the start of supplying the auxiliary energy from the auxiliary power source 502 is waited.

When the counting of the delay time Td comes to an end, the determination is Yes and the process proceeds to step S170.

At step S170 of driving the auxiliary element, the driving signal VGS is applied to the auxiliary element 520 from the driver 521 to turn on the auxiliary element 520.

While the auxiliary element 520 is turned on, the energy is continuously inputted thereto from the boosting capacitor 515 to maintain discharge.

Then at step S180 of determining lapse of a discharge period, it is determined whether the discharge period TDC in which the counting has been started synchronously with the falling of the ignition signal IGt has elapsed.

Until the discharge period TDC elapses, the determination is No and step S180 is repeated.

When the discharge period TDC comes to an end, the determination is Yes, and the process proceeds to step S190.

At step S190 of stopping the auxiliary element, the driving of the auxiliary element 520 is stopped and the energy input from the auxiliary power source 502 is ended.

The delay time Td and the discharge period TDC are interpolated with values suitable for the operating state by an interpolation method described below.

Figure 8A:
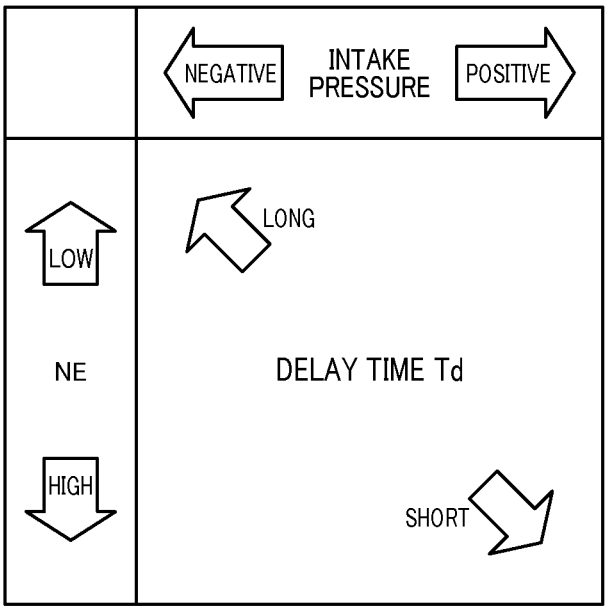
FIG. 8A is a diagram illustrating an example of a map for interpolating delay time Td from engine parameters.
Figure 8B:
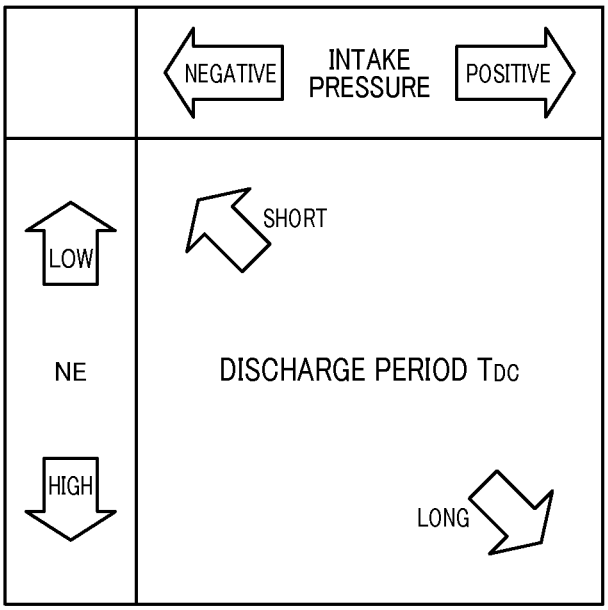
FIG. 8B is a diagram illustrating an example of a map for interpolating a discharge period TDC from engine parameters.

Referring to FIGS. 8A and 8B, the interpolation method of the delay time Td and the discharge period TDC will be described.

To interpolate the delay time Td, a map data illustrated in FIG. 8A is stored in the delay time calculating unit 210 or the ECU 506. The length of the delay time Td is determined according to the operating state of the internal combustion engine that has been determined from the engine parameters EPr, for interpolation in the control process described above.

For example, when both the engine speed Ne and the intake pressure PIN are low, ignition is easy and a value for elongating the delay time Td is selected.

In contrast, when both the engine speed Ne and the intake pressure PIN are high, ignition is difficult and a value for shortening the delay time Td is selected.

As a result, in the operation condition where ignition is easy, the timing of starting energy input from the auxiliary power source 502 is delayed to minimize power consumption. In the operation condition where ignition is difficult, the energy input from the auxiliary power source 502 is started earlier to maintain the secondary current I2.

Similarly, a map data for the discharge period TDC illustrated in FIG. 8B is stored in the delay time calculating unit 210 or the ECU 506. The length of the discharge period TDC is determined according to the operating state of the internal combustion engine that has been determined from the engine parameters EPr, for interpolation in the control process described above.

For example, when both the engine speed Ne and the intake pressure PIN are low, ignition is easy and a value for shortening the discharge period TDC is selected.

In contrast, when both the engine speed Ne and the intake pressure PIN are high, ignition is difficult and a value for elongating the discharge period TDC is selected.

As a result, in the operation condition where ignition is easy, the period for inputting energy from the auxiliary power source 502 is decreased to minimize power consumption, while the period for inputting energy from the auxiliary power source 502 is increased in the operation condition where ignition is difficult to maintain the secondary current I2.

Besides the engine speed Ne and the intake pressure PIN, the operating state of the engine can also be known from the accelerator opening Th, the crank angle CA, the water temperature of the engine Tw, the EGR ratio, the air-fuel ratio A/F, and the like. If it is determined that the revolution and the load are high, the discharge delay time Td is shortened and the discharge period TDC is elongated. If it is determined that the revolution and the addition are low, the discharge delay time Td is elongated and the discharge period TDC is shortened.

The primary voltage V1, the primary current I1, the secondary voltage V2, and the secondary current I2 of the ignition coil 504 may be directly read. In this case, if it is determined, based on the change of the read values, that maintaining the discharge is difficult, the discharge delay time Td is shortened and the discharge period TDC is elongated to realize stable ignition.

Referring to FIGS. 9A, 9B, 10A, and 10B, hereinafter will be described the results of experiments conducted by the inventors of the present invention to confirm the advantageous effects of the present invention.

Figure 9A:
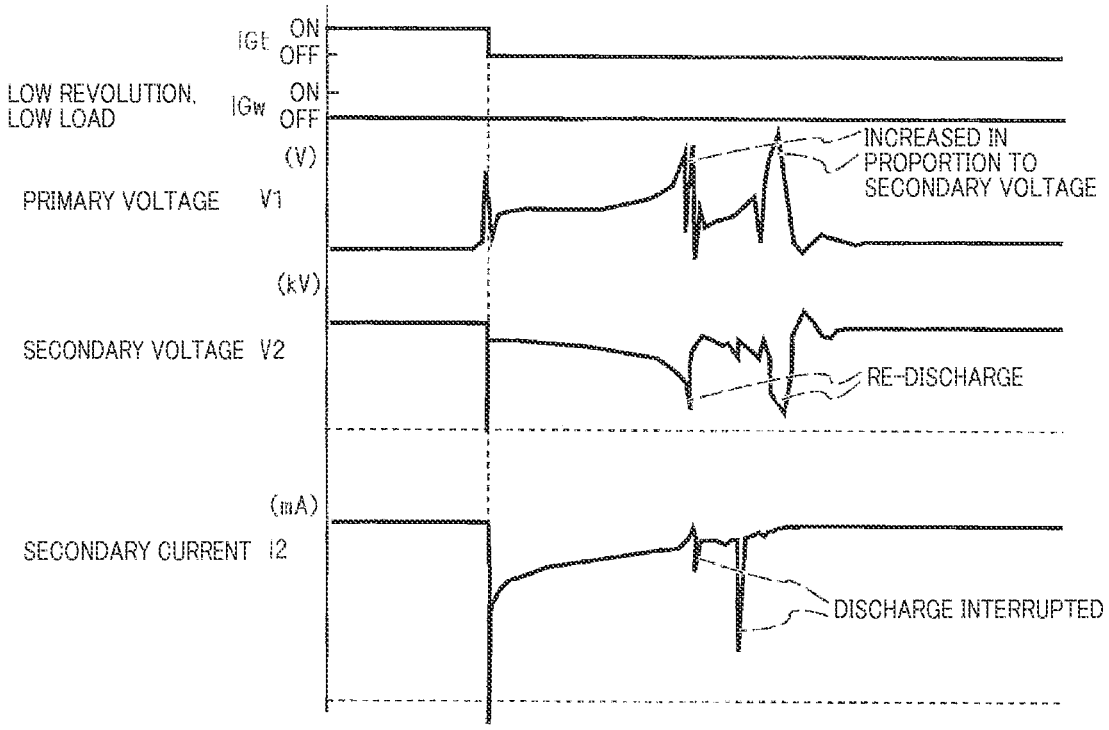
FIG. 9A is a characteristic diagram illustrating an ignition control apparatus of conventional art provided as Comparative Example 2 showing a problem raised in a low-revolution and small-load operating state.

FIG. 9A is a characteristic diagram illustrating problems of the conventional ignition control apparatus as Comparative Example 2, to which the present invention is not applied, in the case where ignition is performed under low-revolution and low-load operation conditions.

When the discharge path formed in the ignition plug 505 is extended by the air flow in the cylinder flowing through the combustion chamber at a later stage of the discharge, there is a risk of increasing the discharge voltage, interrupting the secondary current I2 instantaneously, and causing fire.

Figure 9B:
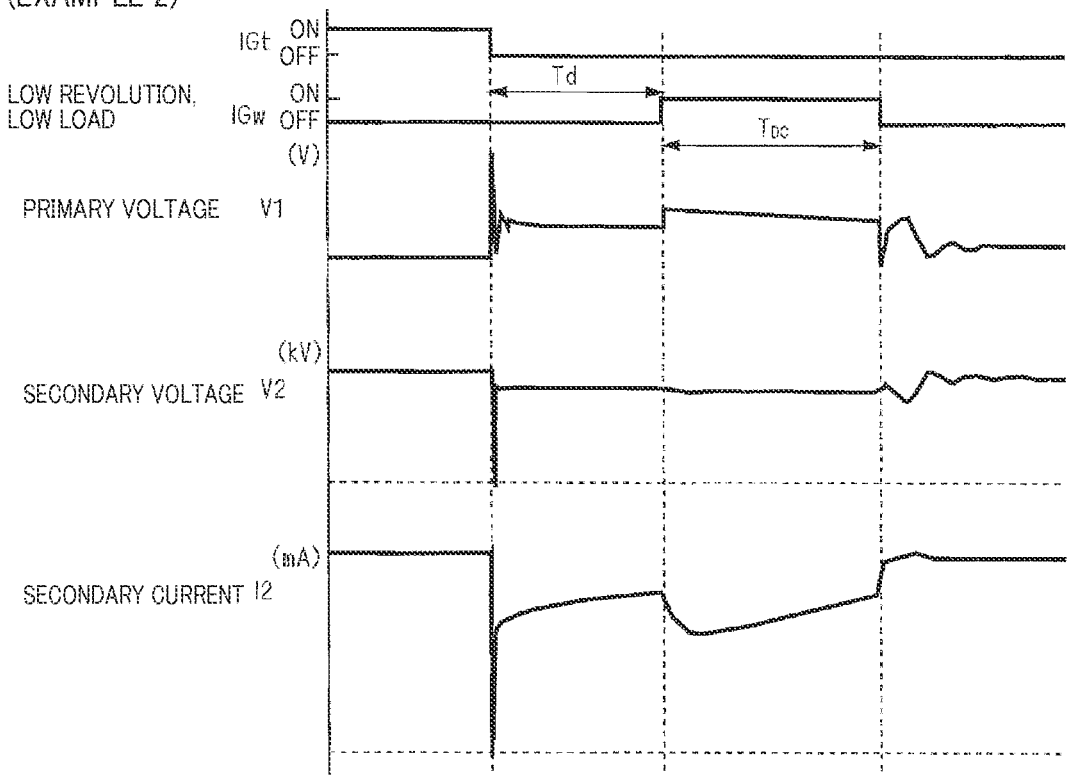
FIG. 9B is a characteristic diagram illustrating the advantageous effects of the present invention provided as Example 2 in a low-revolution and small-load operating state.

In contrast, as illustrated in FIG. 9B as Example 2, when ignition is performed under low-revolution and low-load operation conditions using the ignition control apparatus of the present invention, the energy input from the auxiliary power source 502 is delayed until a later stage of discharge when blow-off of the discharge is likely to occur, followed by the start of energy input from the auxiliary power source 502 after a lapse of the predetermined delay time Td.

With this configuration, energy is inputted from the auxiliary power source 502 in a period covering from the vicinity of the blow-off limit current where blow-off is easily caused, to a later stage of discharge where blow-off is easily caused. Accordingly, discharge can be maintained with a minimum energy.

Figure 10A:
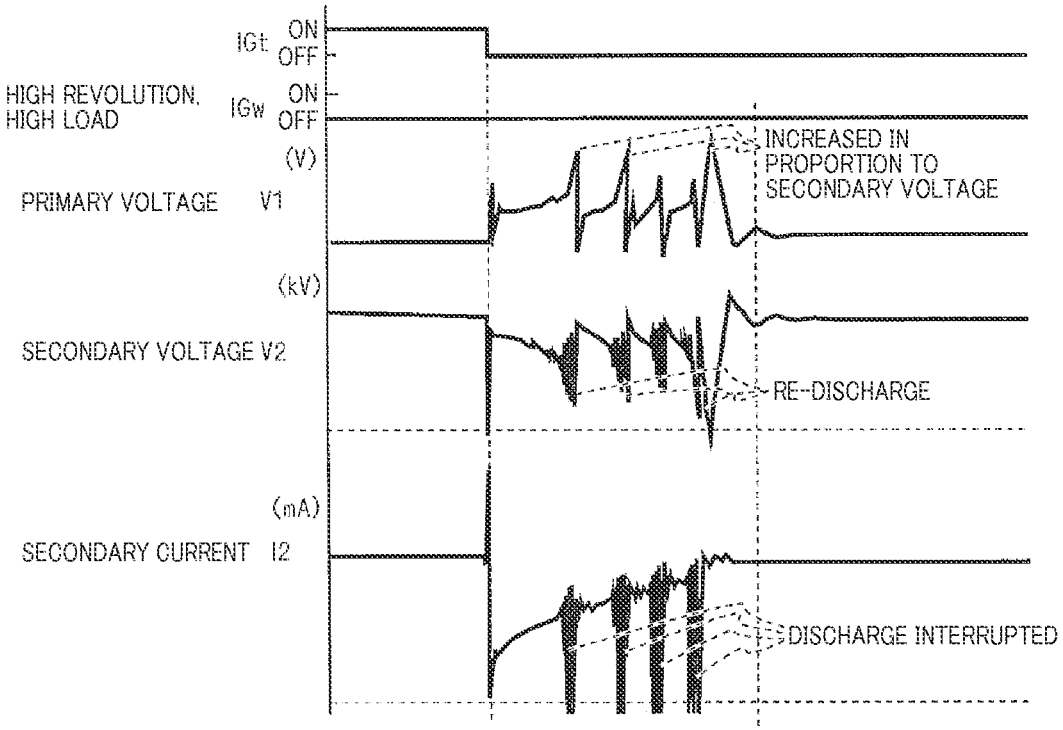
FIG. 10A is a characteristic diagram illustrating an ignition control apparatus of conventional art provided as Comparative Example 3 showing a problem raised in a high-revolution and large-load operating state.

FIG. 10A is a characteristic diagram illustrating problems of a conventional ignition control apparatus as Comparative Example 3 to which the present invention is not applied, in the case where the ignition is performed under high-revolution and high-load operation conditions.

In Comparative Example 3, due to the influence of a strong air flow in the cylinder, blow-off occurs earlier, the number of times of blow-off occurring is larger, and the energy consumption by re-discharge is larger than in Comparative Example 2. Accordingly, there is a higher risk of causing a fire.

Figure 10B:
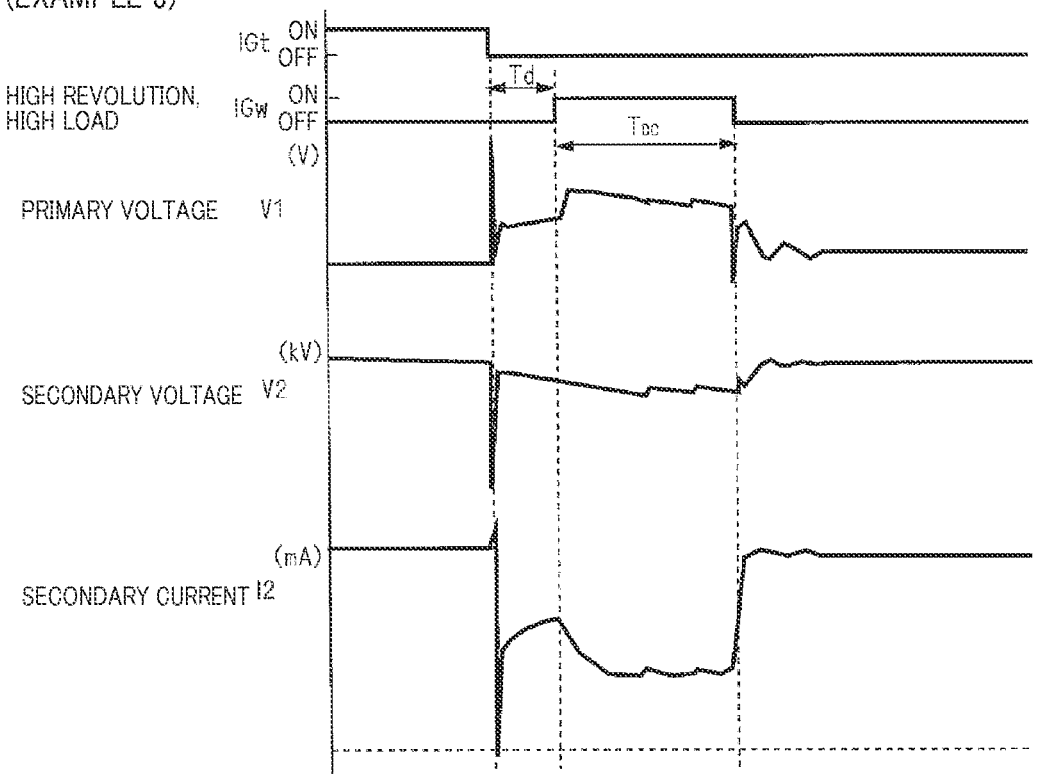
FIG. 10B is a characteristic diagram illustrating the advantageous effects of the present invention provided as Example 3 in a high-revolution and large-load operating state.

FIG. 10B illustrates, as Example 3, the case where ignition is performed under high-revolution and high-load operation conditions using the ignition control apparatus of the present invention. In this case, since blow-off of discharge is likely to occur earlier, the delay time Td for delaying discharge from the auxiliary power source 502 is shortened, the energy input from the auxiliary power source 502 is started earlier, and discharge period TDC is elongated.

With this configuration, it is confirmed that the increase of the secondary voltage V2 is minimized, the discharge path is maintained, and the stable ignition is achieved without blowing off the discharge path.

(1) Desirably, as the engine speed Ne of the internal combustion engine 508 or the load (intake pressure PIN) of the internal combustion engine 508 is decreased, the delay time Td from the falling of the ignition signal IGt to the start of the open/close driving of the auxiliary open/close element 520 is elongated. Further, as the engine speed Ne of the internal combustion engine 508 or the load (intake pressure PIN) of the internal combustion engine 508 is increased, it is desirable that the delay time Td before the start of the open/close driving of the auxiliary open/close element 520 be shortened.

(2) Desirably, as the engine speed Ne of the internal combustion engine 508 or the load (intake pressure PIN) of the internal combustion engine 508 is decreased, the discharge period TDC during which the discharge is maintained by the open/close driving of the auxiliary open/close element 520 is shortened. Further, as the engine speed Ne of the internal combustion engine 508 or the load (intake pressure PIN) of the internal combustion engine 508 is increased, it is desirable that the discharge period TDC during which the discharge is maintained by the open/close driving of the auxiliary open/close element 520 be elongated.

The engine parameters EPr that indicate the operating state of the internal combustion engine are not limited to the engine speed Ne and the intake pressure PIN. The engine parameters may be appropriately selected from the parameters described above.

Third Embodiment

Figure 11:
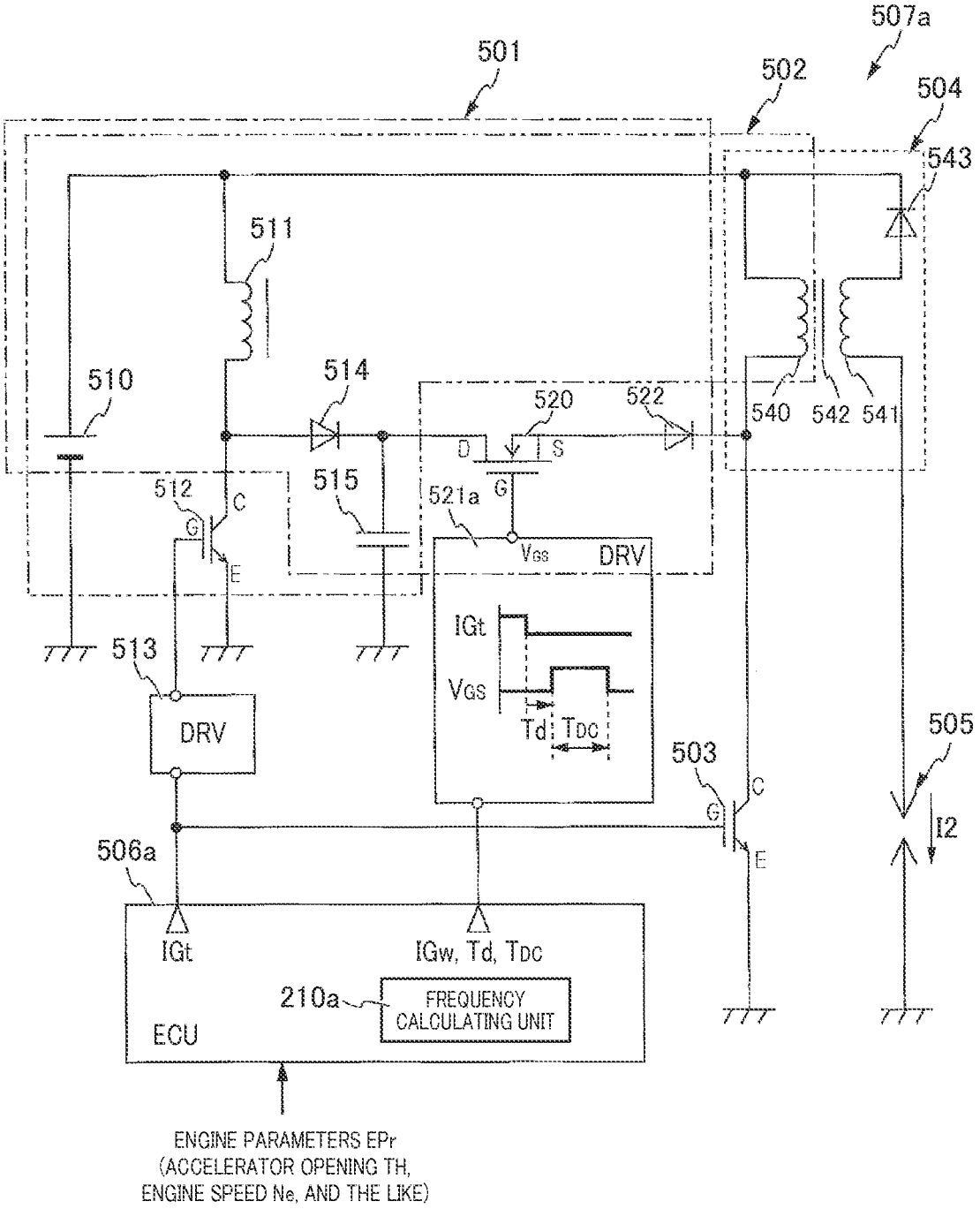
FIG. 11 is a diagram schematically illustrating a configuration of an ignition control apparatus according to a third embodiment of the present invention.

Referring to FIG. 11, an ignition control apparatus 507*a* according to a third embodiment of the present invention will be described. The same reference signs are given to portions of the configuration similar to those of the above embodiments, and alphabetical branch numbers are given to portions that differ from those of the above embodiments. Therefore, the description of the similar configuration portions is omitted and only characteristic portions will be described.

In the second embodiment described above, the delay time calculating unit 210 is provided to the driver 521. The present embodiment is different from this configuration in that the delay time calculating unit 210 is provided to the ECU 506 and, as a result of the calculation in the ECU 506, the delay time Td and the discharge period TDC are ensured to be transmitted to a driver 521*a* in a manner of being superposed with the ignition signal IGt.

Similar to the above embodiments, the present embodiment can also achieve both of stable ignition and minimization of power consumption by inputting the right amount of energy from the auxiliary power source 502 according to the operating state of the internal combustion engine.

Fourth Embodiment

Figure 12:
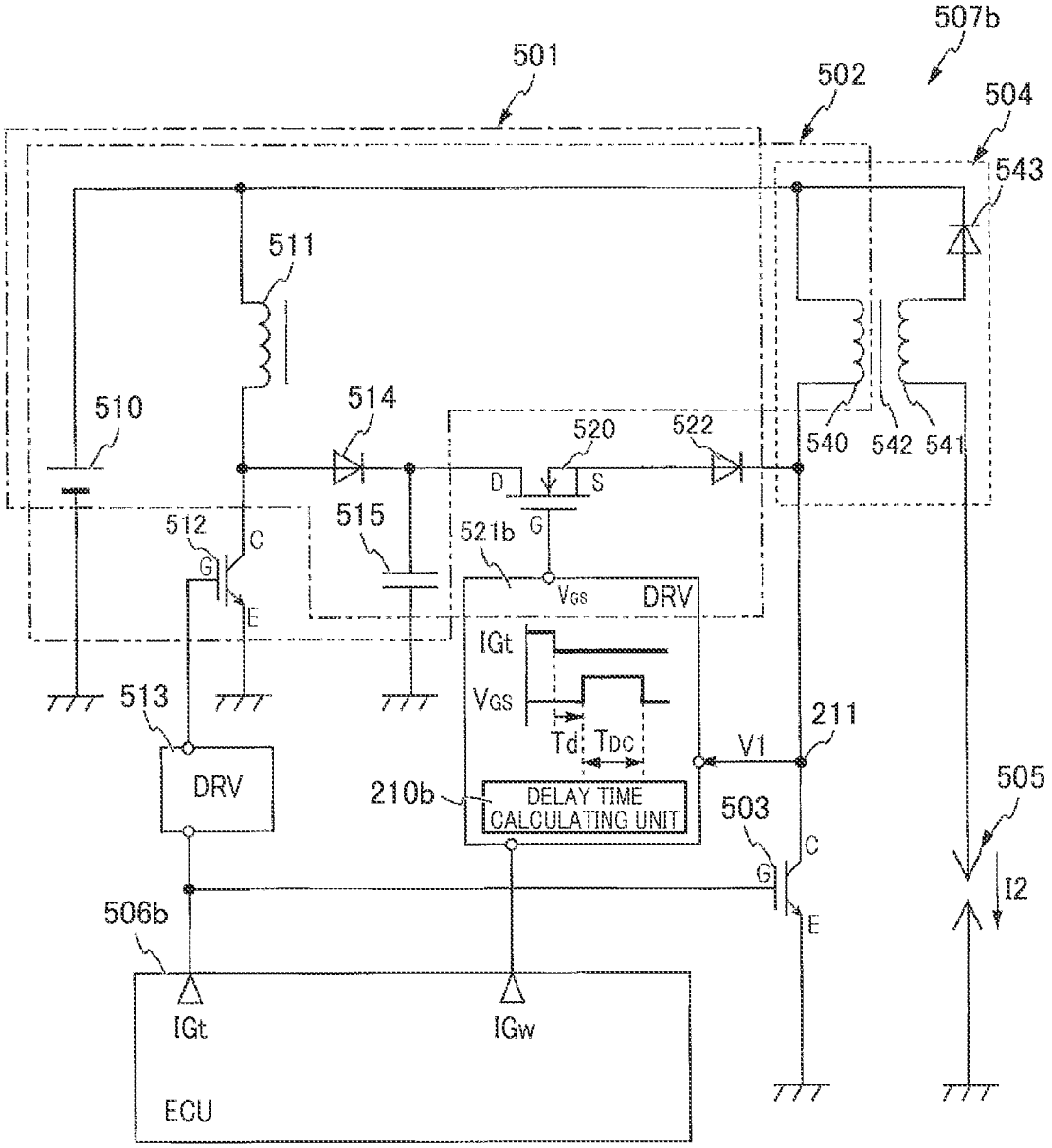
FIG. 12 is a diagram schematically illustrating a configuration of an ignition control apparatus according to a fourth embodiment of the present invention.

Referring to FIG. 12, an ignition control apparatus 507*b* according to a fourth embodiment of the present invention will be described.

In the second and third embodiments described above, the data detected by the operating state confirming units 509, not shown, provided to the internal combustion engine 508 are shown as the engine parameters EPr. The units 509 in this case include the engine speed sensor, the intake pressure sensor, the accelerator opening meter, the crank angle sensor, the water temperature meter of the engine, and the like. The present embodiment is different from this configuration in that a primary voltage detecting unit 211 for detecting the primary voltage V1 of the ignition coil 504 is provided to estimate the change of the secondary voltage V2 on the basis of the primary voltage V1 and to feedback the estimation to a delay time calculating unit 210*b* to calculate the delay time Td and the discharge period TDC.

In this embodiment as well, the advantageous effects similar to those of the embodiments described above can be obtained. Further, the change of the secondary voltage may be estimated based on the primary current, or the secondary voltage V2 and the secondary current I2 may be measured to estimate the change for use in the control.

As a matter of course, other modifications not specifically referred to herein should also be encompassed in the technical scope of the present invention as far as the essential part of the invention is not changed. In addition, the elements expressed in terms of the effects and functions in the various components configuring the means of the present invention for solving the problems should also encompass any configuration capable of realizing the advantageous effects and functions of the present invention, in addition to the specific configurations and equivalents thereof that are disclosed in the embodiments and variations described above.

REFERENCE SIGNS LIST

11, 508 Internal combustion engine (engine)
11*b* Cylinder
19, 505 Ignition plug
30, 507 Ignition control apparatus
31 Ignition circuit unit
32 Electronic control unit
311 Ignition coil
311*a*, 540 Primary winding (L1)
311*b*, 541 Secondary winding (L2)
312, 510 DC power source
313 First switching element
313C First power source side terminal
313E First grounded side terminal
313G First control terminal
314 Second switching element
314D Second power source side terminal
314G Second control terminal
314S Second grounded side terminal
315 Third switching element
315C Third power source side terminal
315E Third grounded side terminal
315G Third control terminal
316 Energy storing coil
317 Capacitor
319 Driver circuit
509 Operating state confirming unit
501 Boosting circuit
511 Energy storing inductor
512 Boosting open/close element (PTr12)
513 Boosting open/close element driver
514 First rectifying element
515 Boosting capacitor (C)
502 Auxiliary power source
520 Auxiliary open/close element (MOS 20)
521 Auxiliary open/close element driving circuit (auxiliary driver)
210 Delay time calculating unit
522 Second rectifying element
503 Ignition open/close element (PTr3)
504 Ignition coil
542 Core
543 Rectifying element
506 Engine control unit (ECU)
IGa First control signal
IGb Second control signal
IGc Third control signal
IGt Ignition signal
IGw Discharge period signal, energy input period signal
EPr Engine parameter
Td Delay time
TDC Discharge period
V1 Primary voltage
V2 Secondary voltage
I2 Secondary current

What is claimed is:

1. An ignition control apparatus configured to control operation of an ignition plug, which is provided to ignite a fuel-air mixture in a cylinder of an internal combustion engine, the apparatus comprising:

an ignition coil including a primary winding and a secondary winding and configured to increase/decrease a primary current, which passes through the primary winding, to generate a secondary current in the secondary winding connected to the ignition plug;

a DC power source having a non-grounded side output terminal connected to one end side of the primary winding, so as to cause the primary current to pass through the primary winding;

a first switching element configured as a semiconductor switching element including a first control terminal, a first power source side terminal, and a first grounded side terminal, and configured to control turn-on and turn-off of current supply between the first power source side terminal and the first grounded side terminal on the basis of a first control signal inputted to the first control terminal, the first switching element having the first power source side terminal connected to the other end side of the primary winding and the first grounded side terminal connected to the grounded side;

a second switching element configured as a semiconductor switching element including a second control terminal, a second power source side terminal, and a second grounded side terminal, and configured to control turn-on and turn-off of current supply between the second power source side terminal and the second grounded side terminal on the basis of a second control signal inputted to the second control terminal;

a third switching element configured as a semiconductor switching element including a third control terminal, a third power source side terminal, and a third grounded side terminal, and configured to control turn-on and turn-off of current supply between the third power source side terminal and the third grounded side terminal on the basis of a third control signal inputted to the third control terminal;

an energy storing coil configured as an inductor interposed on a power line that connects the non-grounded side output terminal of the DC power source and the third power source side terminal of the third switching element to store energy when the third switching element is turned on;

a capacitor disposed between the non-grounded side output terminal and the grounded side of the DC power source and connected in series with the energy storing coil to store energy when the third switching element is turned off, the capacitor being connected in parallel with the third switching element relative to the energy storing coil; and a control unit provided to control the second switching element and the third switching element so as to supply the primary current to the primary winding from the other end side thereof by discharging the stored energy from the capacitor when the second switching element is turned on during ignition discharge of the ignition plug started by turning off the first switching element, the control unit controlling the second switching element or the third switching element so as to provide variability to the amount of stored energy or the amount of stored energy discharged from the capacitor according to an operating state of the internal combustion engine, so as to prevent occurrence of blow-off of the discharge of the ignition plug and a loss of ignition energy accompanying the blow-off of the discharge of the ignition plug.

2. The ignition control apparatus according to claim 1, wherein the control unit increases an amount of energy discharge from the capacitor in a high load range or a high revolution range of the internal combustion engine.

3. An ignition control apparatus at least comprising:

a DC power source;

a boosting circuit boosting a power source voltage of the DC power source;

an ignition coil increasing and decreasing a current of a primary winding connected to the boosting circuit to generate a high secondary voltage in a secondary winding; and an ignition open/close element switching supply and interruption of current supply to the primary winding according to an ignition signal generated according to an operating state of an engine, the ignition control apparatus being connected to the secondary winding to control an operation of an ignition plug that generates spark discharge in a combustion chamber of an internal combustion engine in response to application of a secondary voltage from the secondary winding, wherein the apparatus further comprises:

an auxiliary power source performing discharge and non-discharge of current in a superimposed manner from the boosting circuit from an ignition open/close element side of the primary winding after a lapse of a predetermined delay time from start of the discharge of the ignition plug by the open/close of the ignition open/close element to increase current passing through the secondary winding such that a discharge current for ignition discharge of the ignition plug is not repeatedly cleared to zero between a start and an end of ignition discharge in a single combustion stroke;

an auxiliary open/close element switching discharge and non-discharge of current from the auxiliary power source;

an auxiliary open/close element driving circuit that drives open/close of the auxiliary open/close element; and a delay time calculating unit delaying start of driving of the auxiliary open/close element by a predetermined delay time from an end position of the ignition signal according to both engine speed and the intake pressure, which are parameters that indicate an operating state of the internal combustion engine, so as to prevent occurrence of blow-off of the discharge of the ignition plug and a loss of ignition energy accompanying the blow-off of the discharge of the ignition plug.

4. The ignition control apparatus according to claim 3, wherein:

the delay time calculating unit elongates the delay time for starting open/close driving of the auxiliary open/close element, as revolution of the internal combustion engine is decreased or a load of the internal combustion engine is decreased, and shortens the delay time for starting open/close driving of the auxiliary open/close element, as the revolution of the internal combustion engine is increased or the load of the internal combustion engine is increased, according to the operating state of the internal combustion engine determined on the basis of one or more engine parameters selected from an engine speed, an intake pressure, an accelerator opening, an crank angle, a water temperature of the engine, an EGR ratio, an air-fuel ratio, a primary voltage of the ignition coil, a primary current of the ignition coil, a secondary voltage of the ignition coil, and a secondary current of the ignition coil.

5. The ignition control apparatus according to claim 3, wherein the ignition control apparatus shortens a discharge period for maintaining discharge by the open/close driving of the auxiliary open/close element, as the revolution of the internal combustion engine is decreased or the load of the internal combustion engine is decreased, and elongates the discharge period for maintaining discharge by the open/close driving of the auxiliary open/close element, as the revolution of the internal combustion engine is increased or the load of the internal combustion engine is increased.

6. The ignition control apparatus according to claim 3, wherein the delay time calculating unit or an engine control unit stores map data for interpolating the delay time and the discharge period according to the operating state of the internal combustion engine determined from engine parameters.

7. The ignition control apparatus according to claim 3, wherein an energy input from the auxiliary power source is performed from a connection point between the primary winding and the ignition open/close element for the primary winding.

8. The ignition control apparatus according to claim 3, wherein the boosting circuit includes an energy storing inductor connected to the DC power source, an open/close element switching between supply and interruption of current to the inductor at a predetermined cycle according to the ignition signal, a capacitor connected parallel to the inductor, and a first rectifying element rectifying current passed to the capacitor from the inductor.

9. The ignition control apparatus according to claim 3, wherein the auxiliary power source is interposed between a capacitor and the primary winding, and includes the auxiliary open/close element switching between discharge and non-discharge of current from the capacitor, a second rectifying element rectifying current passed from the capacitor to the primary winding, the DC power source, an inductor, and the capacitor.

10. An ignition control apparatus at least comprising:

a DC power source;

a boosting circuit boosting a power source voltage of the DC power source;

an ignition coil increasing and decreasing a current of a primary winding connected to the boosting circuit to generate a high secondary voltage in a secondary winding; and an ignition open/close element switching supply and interruption of current supply to the primary winding according to an ignition signal generated according to an operating state of an engine, the ignition control apparatus being connected to the secondary winding to control an operation of an ignition plug that generates spark discharge in a combustion chamber of an internal combustion engine in response to application of a secondary voltage from the secondary winding, wherein the apparatus further comprises:

an auxiliary power source performing discharge and non-discharge of current in a superimposed manner from the boosting circuit from an ignition open/close element side of the primary winding after a lapse of a predetermined delay time from start of the discharge of the ignition plug by the open/close of the ignition open/close element to increase current passing through the secondary winding such that a discharge current for ignition discharge of the ignition plug is not repeatedly cleared to zero between a start and an end of ignition discharge in a single combustion stroke;

an auxiliary open/close element switching discharge and non-discharge of current from the auxiliary power source;

an auxiliary open/close element driving circuit that drives open/close of the auxiliary open/close element; and a delay time calculating unit delaying start of driving of the auxiliary open/close element by a predetermined delay time from an end position of the ignition signal according to an interpolation of map data of engine parameters that indicate an operating state of the internal combustion engine, so as to prevent occurrence of blow-off of the discharge of the ignition plug and a loss of ignition energy accompanying the blow-off of the discharge of the ignition plug.

11. The ignition control apparatus according to claim 10, wherein:

the delay time calculating unit elongates the delay time for starting open/close driving of the auxiliary open/close element, as revolution of the internal combustion engine is decreased or a load of the internal combustion engine is decreased, and shortens the delay time for starting open/close driving of the auxiliary open/close element, as the revolution of the internal combustion engine is increased or the load of the internal combustion engine is increased, according to the operating state of the internal combustion engine determined on the basis of one or more engine parameters selected from an engine speed, an intake pressure, an accelerator opening, an crank angle, a water temperature of the engine, an EGR ratio, an air-fuel ratio, a primary voltage of the ignition coil, a primary current of the ignition coil, a secondary voltage of the ignition coil, and a secondary current of the ignition coil.

12. The ignition control apparatus according to claim 10, wherein the ignition control apparatus shortens a discharge period for maintaining discharge by the open/close driving of the auxiliary open/close element, as the revolution of the internal combustion engine is decreased or the load of the internal combustion engine is decreased, and elongates the discharge period for maintaining discharge by the open/close driving of the auxiliary open/close element, as the revolution of the internal combustion engine is increased or the load of the internal combustion engine is increased.

13. The ignition control apparatus according to claim 10, wherein the delay time calculating unit or an engine control unit stores map data for interpolating the delay time and the discharge period according to the operating state of the internal combustion engine determined from engine parameters.

14. The ignition control apparatus according to claim 10, wherein an energy input from the auxiliary power source is performed from a connection point between the primary winding and the ignition open/close element for the primary winding.

15. The ignition control apparatus according to claim 10, wherein the boosting circuit includes an energy storing inductor connected to the DC power source, an open/close element switching between supply and interruption of current to the inductor at a predetermined cycle according to the ignition signal, a capacitor connected parallel to the inductor, and a first rectifying element rectifying current passed to the capacitor from the inductor.

16. The ignition control apparatus according to claim 10, wherein the auxiliary power source is interposed between a capacitor and the primary winding, and includes the auxiliary open/close element switching between discharge and non-discharge of current from the capacitor, a second rectifying element rectifying current passed from the capacitor to the primary winding, the DC power source, an inductor, and the capacitor.

* * * * *